US012709504B2

(12) United States Patent
Noji et al.

(10) Patent No.: US 12,709,504 B2
(45) Date of Patent: Aug. 18, 2026

(54) SHEET CONVEYANCE APPARATUS AND IMAGE FORMING APPARATUS

(71) Applicant: CANON KABUSHIKI KAISHA, Tokyo (JP)

(72) Inventors: Yutaro Noji, Kanagawa (JP); Masaaki Takeuchi, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 229 days.

(21) Appl. No.: 18/529,051

(22) Filed: Dec. 5, 2023

(65) Prior Publication Data

US 2024/0199354 A1 Jun. 20, 2024

(30) Foreign Application Priority Data

Dec. 14, 2022 (JP) ..... 2022-199833

(51) Int. Cl.
*F16D 1/10* (2006.01)
*B65H 5/06* (2006.01)

(52) U.S. Cl.
CPC ..... *B65H 5/06* (2013.01); *B65H 2403/47* (2013.01); *B65H 2403/73* (2013.01)

(58) Field of Classification Search
CPC ..... F16D 1/10; B65H 5/06; B65H 2403/47; B65H 2403/51; B65H 2403/73; G03G 2221/1657; G03G 21/1647; G03G 21/1857; G03G 21/186
See application file for complete search history.

(56) References Cited

U.S. PATENT DOCUMENTS 9,354,560 B2 * 5/2016 Imaizumi ..... G03G 15/1615
11,150,592 B2 * 10/2021 Okuno ..... G03G 21/186
11,953,853 B2 * 4/2024 Watanabe ..... G03G 15/1615
12,411,447 B2 * 9/2025 Nakamura ..... G03G 15/2053

FOREIGN PATENT DOCUMENTS

JP 2011-174586 A 9/2011

* cited by examiner

*Primary Examiner* — Leslie A Nicholson, III
(74) *Attorney, Agent, or Firm* — VENABLE LLP

(57) ABSTRACT

A sheet conveyance apparatus includes a conveyance member, a drive source, a first member including a first ratchet portion, a second member including a second ratchet portion, and an urging portion. The first ratchet portion has a plurality of first transmission surfaces and a first guide surface. The second ratchet portion has a plurality of second transmission surfaces and a second guide surface. One of the first member and the second member is movable in the axial direction between an engaged position and a separated position. The number of times the holding surface allows the one of the first member and the second member to move from the separated position to the engaged position while the second member rotates once in the rotational direction with respect to the first member is smaller than the number of contact positions included in the plurality of contact positions during the drive transmission period.

23 Claims, 15 Drawing Sheets

FIG.15A
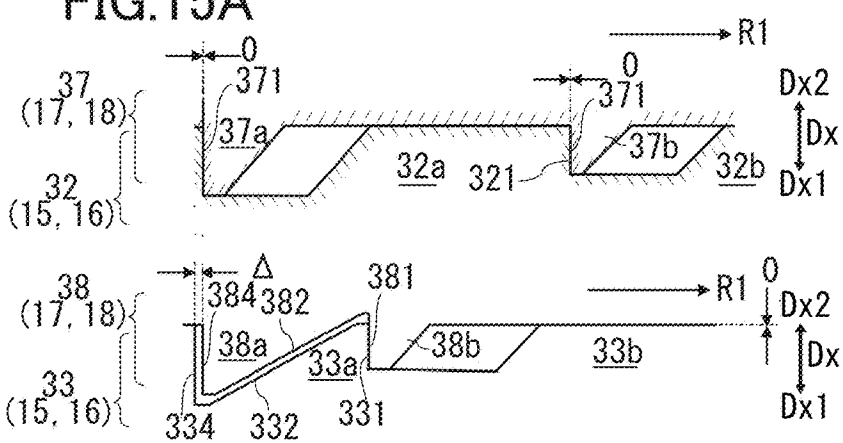
FIG.15B
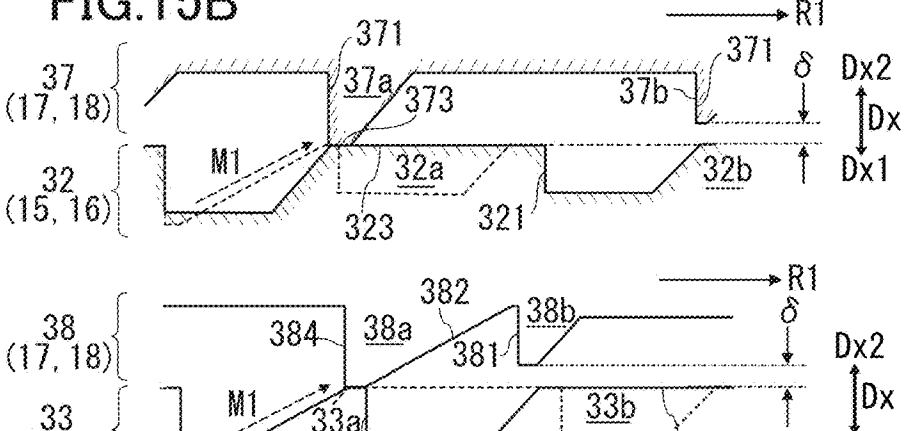
FIG.15C
FIG.15D

SHEET CONVEYANCE APPARATUS AND IMAGE FORMING APPARATUS

BACKGROUND OF THE INVENTION

Field of the Invention

The present invention relates to a sheet conveyance apparatus that conveys a sheet, and an image forming apparatus that forms an image on the sheet.

Description of the Related Art

Japanese Patent Laid-Open No. 2011-174586 discloses an image forming apparatus that transmits a driving force of a drive source to a photosensitive drum and a developing unit via a ratchet mechanism.

SUMMARY OF THE INVENTION

According to an aspect of the invention, a sheet conveyance apparatus includes a conveyance member configured to convey a sheet, a drive source configured to generate a driving force, a first member including a first ratchet portion and being configured to be rotationally driven in a predetermined rotational direction about an axis by the driving force, wherein the first ratchet portion has a plurality of first transmission surfaces and a first guide surface, a second member opposing the first member in an axial direction of the axis, the second member including a second ratchet portion and being configured to rotate about the axis to transmit the driving force received from the first member to the conveyance member, wherein the second ratchet portion has a plurality of second transmission surfaces and a second guide surface, and an urging portion configured to urge one of the first member and the second member toward another of the first member and the second member in the axial direction, wherein the one of the first member and the second member is movable in the axial direction between an engaged position where the plurality of first transmission surfaces is engaged with the plurality of second transmission surfaces, and a separated position where the plurality of first transmission surfaces is separated from the plurality of second transmission surfaces in the axial direction, wherein during a drive transmission period in which the first member is rotationally driven in the rotational direction by the driving force of the drive source, the second member and the first member rotate together in the rotational direction in a state in which (i) the one of the first member and the second member is positioned in the engaged position, (ii) the plurality of first transmission surfaces is in contact with the plurality of second transmission surfaces at a plurality of contact positions in the rotational direction, wherein during an idling period in which the conveyance member is rotated in a state in which the drive source is stopped, the first guide surface and the second guide surface slide on each other such that the one of the first member and the second member is retracted from the engaged position to the separated position against an urging force of the urging portion, and thus the second member is allowed to rotate in the rotational direction with respect to the first member, wherein at least one of the first ratchet portion and the second ratchet portion has a holding surface configured to slide on another of the first ratchet portion and the second ratchet portion after the one of the first member and the second member has retracted from the engaged position to the separated position during the idling period, and thus hold the one of the first member and the second member at the separated position, and wherein the number of times the holding surface allows the one of the first member and the second member to move from the separated position to the engaged position while the second member rotates once in the rotational direction with respect to the first member is smaller than the number of contact positions included in the plurality of contact positions during the drive transmission period.

According to another aspect of the invention, a sheet conveyance apparatus includes a conveyance member configured to convey a sheet, a drive source configured to generate a driving force, a first member including a first ratchet portion and being configured to be rotationally driven in a predetermined rotational direction about an axis by the driving force, wherein the first ratchet portion has a first transmission surface and a first guide surface, a second member opposing the first member in an axial direction of the axis, the second member including a second ratchet portion and being configured to rotate about the axis to transmit the driving force received from the first member to the conveyance member, wherein the second ratchet portion has a second transmission surface and a second guide surface, and an urging portion configured to urge one of the first member and the second member toward another of the first member and the second member in the axial direction, wherein the one of the first member and the second member is movable in the axial direction between an engaged position where the first transmission surface is engaged with the second transmission surface, and a separated position where the first transmission surface is separated from the second transmission surface in the axial direction, wherein during a drive transmission period in which the first member is rotationally driven in the rotational direction by the driving force of the drive source, the second member rotates in the rotational direction together with the first member in a state in which (i) the one of the first member and the second member is positioned in the engaged position, and (ii) a contact portion between the first transmission surface and the second transmission surface is formed, wherein during an idling period in which the conveyance member is rotated in a state in which the drive source is stopped, the first guide surface and the second guide surface slide on each other such that the one of the first member and the second member is retracted from the engaged position to the separated position against an urging force of the urging portion, and thus the second member is allowed to rotate in the rotational direction with respect to the first member, and wherein in a rotational radius direction of the first member, at least part of the contact portion during the drive transmission period is at a more outward position than a sliding surface between the first guide surface and the second guide surface during the idling period.

According to one aspect of the invention, a sheet conveyance apparatus includes a conveyance member configured to convey a sheet, a drive source configured to generate a driving force, a first member including a first ratchet portion and configured to be rotationally driven in a predetermined rotational direction about an axis by the driving force, wherein the first ratchet portion includes a first outer claw portion and a first inner claw portion disposed at a more inward position than the first outer claw portion in a rotational radius direction of the first member, a second member opposing the first member in an axial direction of the axis, the second member including a second ratchet portion and being configured to rotate about the axis to transmit the driving force received from the first member to the conveyance member, wherein the second ratchet portion includes a second outer claw portion and a second inner claw portion disposed at a more inward position than the second outer claw portion in the rotational radius direction of the first member, and an urging portion configured to urge one of the first member and the second member toward another of the first member and the second member in the axial direction, wherein the one of the first member and the second member is movable in the axial direction between an engaged position where the first outer claw portion and the first inner claw portion are respectively engaged with the second outer claw portion and the second inner claw portion, and a separated position where the first outer claw portion and the first inner claw portion are respectively separated from the second outer claw portion and the second inner claw portion in the axial direction, wherein during a drive transmission period in which the first member is rotationally driven in the rotational direction by the driving force of the drive source, the second member and the first member rotate together in the rotational direction in a state in which the one of the first member and the second member is positioned at the engaged position, wherein during an idling period in which the conveyance member is rotated in a state in which the drive source is stopped, a third guide surface provided on the first outer claw portion and the first inner claw portion and a fourth guide surface provided on the second outer claw portion and the second inner claw portion slide on each other such that the one of the first member and the second member is retracted from the engaged position to the separated position against an urging force of the urging portion, and thus the second member is allowed to rotate in the rotational direction with respect to the first member, wherein at least one of the first outer claw portion and the second outer claw portion has a first holding surface, wherein at least one of the first inner claw portion and the second inner claw portion has a second holding surface, and wherein after the one of the first member and the second member has retracted from the engaged position to the separated position during the idling period, the sheet conveyance apparatus switches to a state in which the one of the first member and the second member is held at the separated position by the first holding surface and a state in which the one of the first member and the second member is held at the separated position by the second holding surface.

Further features of the present invention will become apparent from the following description of exemplary embodiments with reference to the attached drawings.

BRIEF DESCRIPTION OF THE DRAWINGS

FIGS. 15A to 15D are each a diagram for describing the operation of a ratchet mechanism portion according to the third embodiment.

DESCRIPTION OF THE EMBODIMENTS

Embodiments of the present disclosure will be described below with reference to drawings.

First Embodiment

Figure 1:
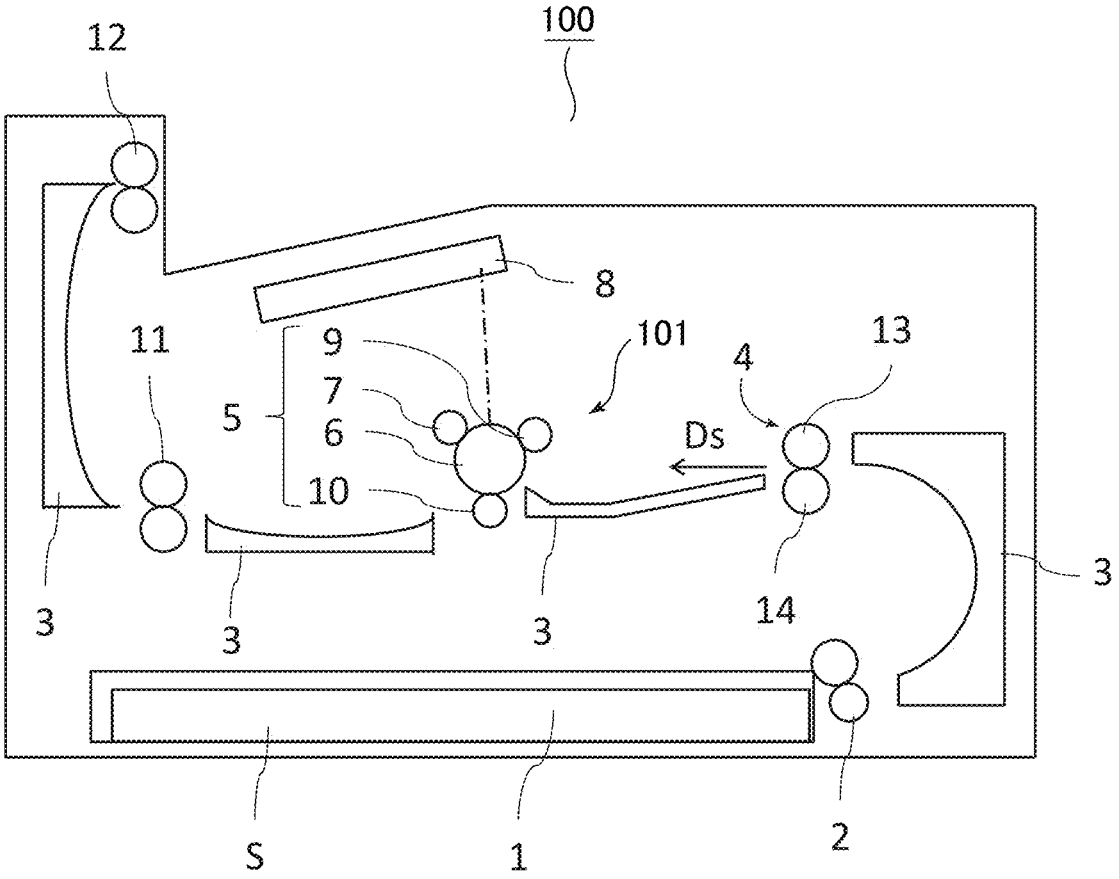
FIG. 1 is a schematic view of an image forming apparatus according to a first embodiment.

FIG. 1 is a schematic view of an image forming apparatus 100 according to a first embodiment. The image forming apparatus 100 forms an image on a sheet S serving as a recording material (recording medium) on the basis of image information received from an external information processing apparatus. As the sheet S, a wide variety of sheet materials of different sizes and materials can be used. Examples of the sheet materials include paper sheets such as plain paper sheets and cardboards, surface-treated sheet materials such as coated paper sheets, sheet materials of irregular shapes such as envelopes and index paper sheets, plastic films, and cloths.

The image forming apparatus 100 includes an image forming portion 101 of an electrophotographic system. The image forming portion 101 includes a photosensitive drum 6 serving as an image bearing member, a charging roller 7 serving as a charging portion, a laser scanner 8 serving as an exposing portion, a developing roller 9 serving as a developing portion, a transfer roller 10 serving as a transfer portion, and a fixing unit 11 serving as a fixing portion. The photosensitive drum 6, the charging roller 7, the developing roller 9, and the transfer roller 10 are configured as a process cartridge 5 attachable to and detachable from the frame body of the image forming apparatus 100.

The photosensitive drum 6 is an electrophotographic photosensitive member formed in a drum shape (cylindrical shape). A transfer nip serving as a transfer portion is formed between the photosensitive drum 6 and the transfer roller 10. Toner serving as developer is accommodated in the process cartridge 5. The fixing unit 11 includes a fixing roller and a pressurizing roller that form a fixing nip, and a heating portion that heats the fixing roller. Examples of the heating portion include a halogen lamp and an induction heating mechanism.

In addition, the image forming apparatus 100 includes a cassette 1 serving as a storage portion (supporting portion) that supports and stores sheets S, a feeding portion 2 that feeds the sheet S, a conveyance portion 4 that conveys the sheet S, and a discharge portion 12 that discharges the sheet S having undergone image formation. Further, the image forming apparatus 100 includes a conveyance guide 3 that guides the sheet S through a conveyance path passing the feeding portion 2, the conveyance portion 4, the transfer nip, the fixing nip, and the discharge portion 12.

As each of the feeding portion 2, the conveyance portion 4, and the discharge portion 12, a conveyance roller pair that conveys the sheet S by rotating while nipping the sheet S can be used. The conveyance portion 4 of the present embodiment includes a conveyance roller 14 (driving roller) that receives the driving force of the drive source, and a conveyance roll 13 (driven roller) that rotates following the conveyance roller 14. The driving configuration of the conveyance portion 4 will be described later.

The image forming operation of the image forming apparatus 100 will be described later. When the controller of the image forming apparatus 100 has received image information, the image forming operation is started. First, the sheets S are fed one by one from the cassette 1 by the feeding portion 2, and the sheet S is conveyed toward the transfer nip via the conveyance portion 4. In contrast, in the image forming portion 101, the photosensitive drum 6 is rotationally driven, and the charging roller 7 uniformly charges the surface of the photosensitive drum 6. The laser scanner 8 is driven on the basis of a signal based on the image information, exposes the photosensitive drum 6 by irradiating the photosensitive drum 6 with laser light, and thus forms an electrostatic latent image on the surface of the photosensitive drum 6. The developing roller 9 bears toner and supplies the toner to the photosensitive drum 6, and thus develops the electrostatic latent image into a toner image. The toner image formed on the photosensitive drum 6 is transferred onto the sheet S in the transfer nip by the transfer roller 10.

The sheet S having passed through the transfer nip is conveyed to the fixing unit 11. The fixing unit 11 heats and pressurizes the toner image on the sheet S while nipping and conveying the sheet S in a fixing nip. As a result of this, an image fixed to the sheet S can be obtained. The sheet S having passed through the fixing unit 11 is discharged to the outside of the image forming apparatus 100 by the discharge portion 12.

To be noted, the image forming apparatus 100 described above is an example of an image forming apparatus. The image forming apparatus is not limited to a monofunctional printer having only an image forming function (printing function), and may be a copier including an image reading apparatus and having a copier function, a multifunctional apparatus having a plurality of functions, or a large printer for commercial use. In addition, the image forming portion 101 described above may be replaced by, for example, an electrophotographic unit of an intermediate transfer system, or an image forming unit of an ink jet system.

Driving Configuration of Conveyance Roller

Figure 2:
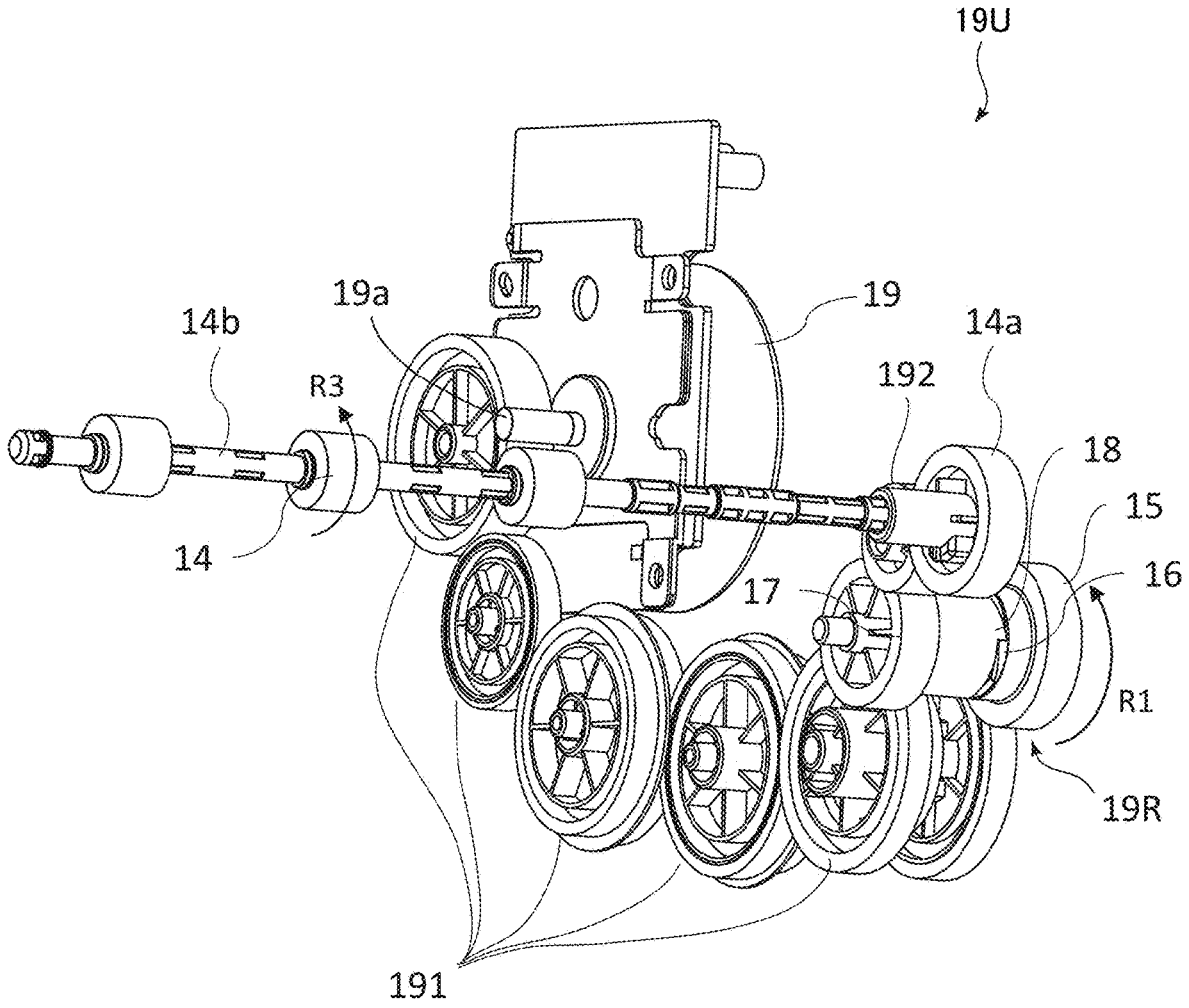
FIG. 2 is a perspective view of a sheet conveyance apparatus according to the first embodiment.
Figure 3:
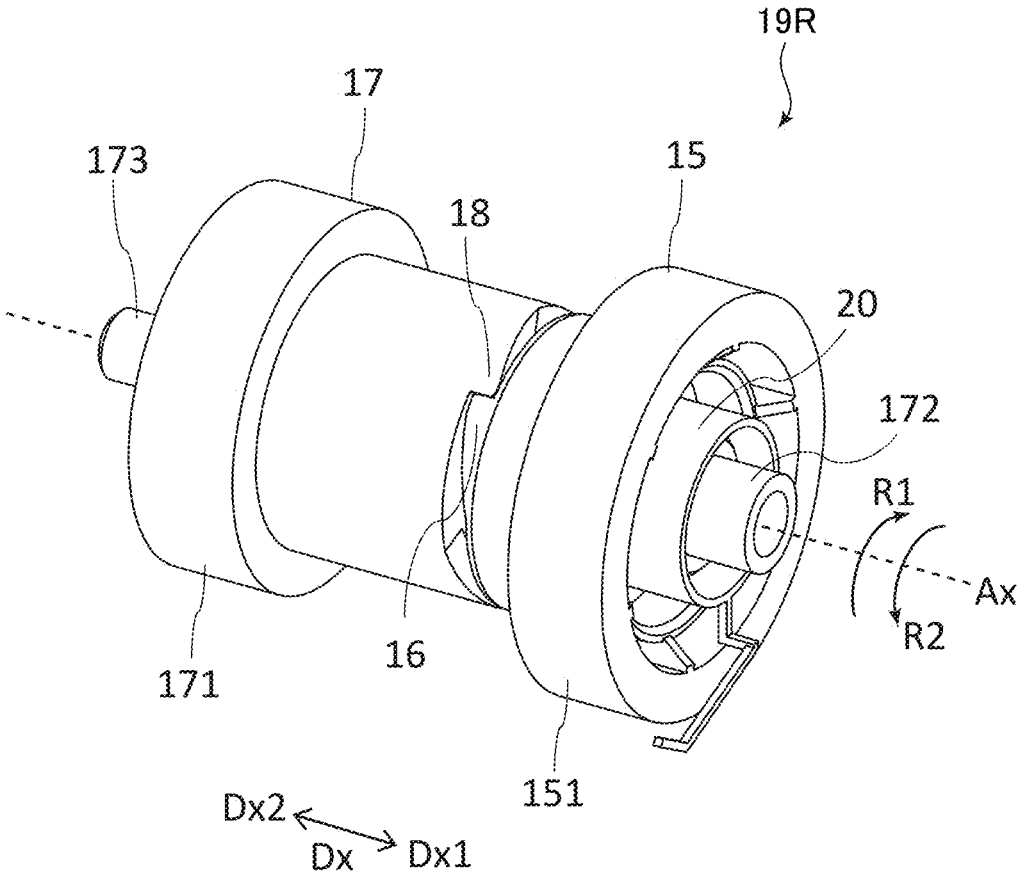
FIG. 3 is a perspective view of a ratchet mechanism portion according to the first embodiment.

Next, the driving configuration of the conveyance roller 14 will be described. FIG. 2 is a perspective view of a driving mechanism 19U (driving unit) that drives the conveyance roller 14 according to the present embodiment. FIG. 3 is a perspective view of a ratchet mechanism portion 19R that is a part of the driving mechanism 19U. The conveyance roller 14 and the driving mechanism 19U constitute a sheet conveyance apparatus of the present embodiment. To be noted, the conveyance roller 14 is an example of a conveyance member that conveys a sheet, and for example, a conveyance member configured to drive an endless belt by a roller may be used.

As illustrated in FIG. 2, the driving mechanism 19U includes a motor 19 serving as a drive source, a gear train 191, a ratchet mechanism portion 19R, an idler gear 192, and a roller gear 14*a*.

The motor 19 is attached to the frame body of the image forming apparatus 100. A pinion gear 19*a* provided on an output shaft of the motor 19 is meshed with one gear in the gear train 191. The gear train 191 includes a plurality of gears meshed with each other. Another gear in the gear train 191 is meshed with a first gear 15 serving as a first member (input element or first drive transmission member) of the ratchet mechanism portion 19R. The idler gear 192 is meshed with a second gear 17 serving as a second member (output element or second drive transmission member) of the ratchet mechanism portion 19R. In addition, the idler gear 192 is meshed with the roller gear 14*a*. The roller gear 14*a* is attached to an end portion of a roller shaft 14*b* that supports the conveyance roller 14, and integrally rotates with the conveyance roller 14.

To be noted, the gear train 191 is an example of a transmission portion that transmits the driving force of the drive source to the ratchet mechanism portion 19R. The idler gear 192 is an example of a transmission portion that transmits a driving force from the ratchet mechanism portion 19R to the conveyance roller 14. These transmission portions may be replaced by, for example, a belt transmission mechanism. In this case, as the first member of the ratchet mechanism portion 19R, a pulley over which a belt is stretched can be used instead of the first gear 15 that is a gear. In addition, the output shaft of the motor 19 may be directly coupled to the first member of the ratchet mechanism portion 19R, and the conveyance roller 14 may be directly coupled to a second member of the ratchet mechanism portion 19R.

As illustrated in FIG. 3, the ratchet mechanism portion 19R includes a first gear 15 including a first ratchet portion 16, a second gear 17 including a second ratchet portion 18, and an urging spring 20.

The first gear 15 and the second gear 17 rotate about an axis Ax that is a rotational axis common to the two. In the description below, the direction of the axis Ax will be referred to as an axial direction Dx. A predetermined rotational direction about the axis Ax in the case where the first gear 15 is rotationally driven by the driving force of the motor 19 will be referred to as a first rotational direction R1, and a rotational direction opposite thereto will be referred to as a second rotational direction R2.

The first gear 15 and the second gear 17 are arranged in the axial direction Dx. In the axial direction Dx, the first gear 15 and the second gear 17 oppose each other. In the description below, in the axial direction Dx, the side on which the first gear 15 is positioned with respect to the second gear 17 will be referred to as a "axial-direction first side Dx1", and the side on which the second gear 17 is positioned with respect to the first gear 15 will be referred to as a "axial-direction second side Dx2".

The first gear 15 includes the first ratchet portion 16 and a gear portion 151 (drive input portion) that engages with a gear of the gear train 191 illustrated in FIG. 2 and described above to receive input of the driving force. The first ratchet portion 16 is provided on the axial-direction second side Dx2 of the first gear 15, that is, on the side facing the second gear 17.

The second gear 17 includes the second ratchet portion 18 and a gear portion 171 (drive output portion) that engages with the idler gear 192 illustrated in FIG. 2 and described above to output the driving force. The second ratchet portion 18 is provided on the axial-direction first side Dx1 of the second gear 17, that is, on the side facing the first gear 15.

The second gear 17 includes shaft portions 172 and 173 rotatably held by a bearing portion provided in a frame body of the image forming apparatus 100. The first gear 15 has a hole portion 152 illustrated in FIGS. 4A and 4B having a cylindrical shape in which the shaft portion 172 of the second gear 17 is inserted. The hole portion 152 of the first gear 15 is supported by the shaft portion 172 such that the first gear 15 is rotatable and slidable in the axial direction Dx. To be noted, for example, a configuration in which the first gear 15 is directly rotatably held by part of the frame body of the image forming apparatus 100 may be employed.

The urging spring 20 is an example of an urging portion that urges one of the first gear 15 and the second gear 17 such that the first ratchet portion 16 and the second ratchet portion 18 engage with each other. The urging spring 20 of the present embodiment is a compression spring that urges the first gear 15 toward the second gear 17, that is, toward the axial-direction second side Dx2.

In the present embodiment, the first gear 15 is movable in the axial direction Dx. The first gear 15 relatively moves with respect to the second gear 17 between a meshing position (engaged position, first position) where the first ratchet portion 16 and the second ratchet portion 18 engage or mesh with each other and a separated position (second position) where the first ratchet portion 16 and the second ratchet portion 18 are disengaged or unmeshed from each other. In contrast, in the present embodiment, the second gear 17 is configured not to move in the axial direction Dx. For example, the shaft portions 172 and 173 of the second gear 17 are supported by the bearing portion provided in the frame body of the image forming apparatus 100 such that the second gear 17 is rotatable about the axis Ax and unmovable in the axial direction Dx.

To be noted, the second gear 17 may be configured to be movable in the axial direction Dx and the first gear 15 may be configured not to move in the axial direction Dx. In this case, the urging spring 20 is disposed so as to urge the second gear 17 toward the first gear 15, that is, toward the axial-direction first side Dx1. Even in the case where the second gear 17 is configured to be movable in the axial direction Dx, a function similar to that of the present embodiment is realized by relative movement between the first gear 15 and the second gear 17 resulting from the movement of the first gear 15 in the axial direction Dx in the description below.

In the case where the first gear 15 rotates in the first rotational direction R1 about the axis Ax, the second gear 17 rotates in the first rotational direction R1 integrally with the first gear 15 in a state in which the first ratchet portion 16 and the second ratchet portion 18 are engaged or meshed with each other. In other words, relative rotation of the second ratchet portion 18 in a second rotational direction R2 (rotational direction opposite to the first rotational direction R1) with respect to the first ratchet portion 16 is restricted. Therefore, the ratchet mechanism portion 19R is capable of transmitting, to the conveyance roller 14, the driving force transmitted from the motor 19 illustrated in FIG. 2 via the engagement or meshing between the first ratchet portion 16 and the second ratchet portion 18.

In contrast, in the case where an external force in the first rotational direction R1 is applied to the second gear 17 in a state in which the first gear 15 does not rotate about the axis Ax, the first ratchet portion 16 and the second ratchet portion 18 slide on each other and disengage from each other. As a result of this, the second gear 17 is allowed to rotate in the first rotational direction R1 while relatively rotating with respect to the first gear 15. In other words, the second ratchet portion 18 is allowed to relatively rotate in the first rotational direction R1 with respect to the first ratchet portion 16.

As a result of the second gear 17 being allowed to rotate in the first rotational direction R1, the conveyance roller 14 coupled to the second gear 17 via the idler gear 192 is allowed to rotate in a predetermined rotational direction R3 illustrated in FIG. 2. The rotational direction R3 is a rotational direction of the conveyance roller 14 in the case of conveying the sheet S in a sheet conveyance direction Ds illustrated in FIG. 1 from the conveyance portion 4 toward the transfer nip.

Therefore, when the user pulls out the sheet S in the sheet conveyance direction Ds from the conveyance roller 14, the first ratchet portion 16 and the second ratchet portion 18 disengage from each other, and thus the coupling between the conveyance roller 14 and the motor 19 is cancelled. That is, the conveyance roller 14 is capable of idling in the rotational direction R3 along the sheet conveyance direction Ds in a state in which the motor 19 is stopped. As a result of this, the force required for the user to pull out the sheet (sheet pull-out force) can be reduced by suppressing addition of the load for rotating the motor 19 in a non-electrified state to the sheet pull-out force.

To be noted, the sheet pull-out force in the case where the user pulls out the sheet S in the sheet conveyance direction Ds from the conveyance roller 14 mainly results from the frictional force in the sliding surface between the first ratchet portion 16 and the second ratchet portion 18. This frictional force is generated as a result of the first ratchet portion 16 and the second ratchet portion 18 sliding on each other in the state of being pressed against each other by the urging spring 20. Therefore, the sheet pull-out force is the largest when the first ratchet portion 16 and the second ratchet portion 18 are the farthest from each other in the axial direction Dx, that is, when the urging spring 20 is compressed the most.

Figure 4A:
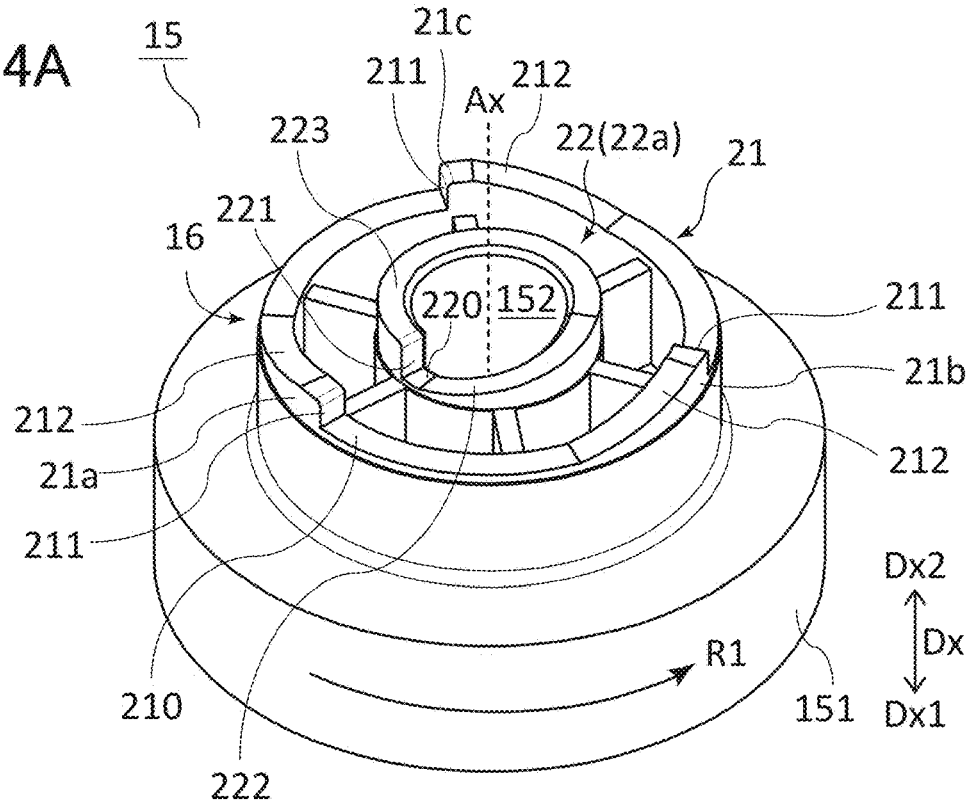
FIG. 4A is a perspective view of a first gear according to the first embodiment.
Figure 4B:
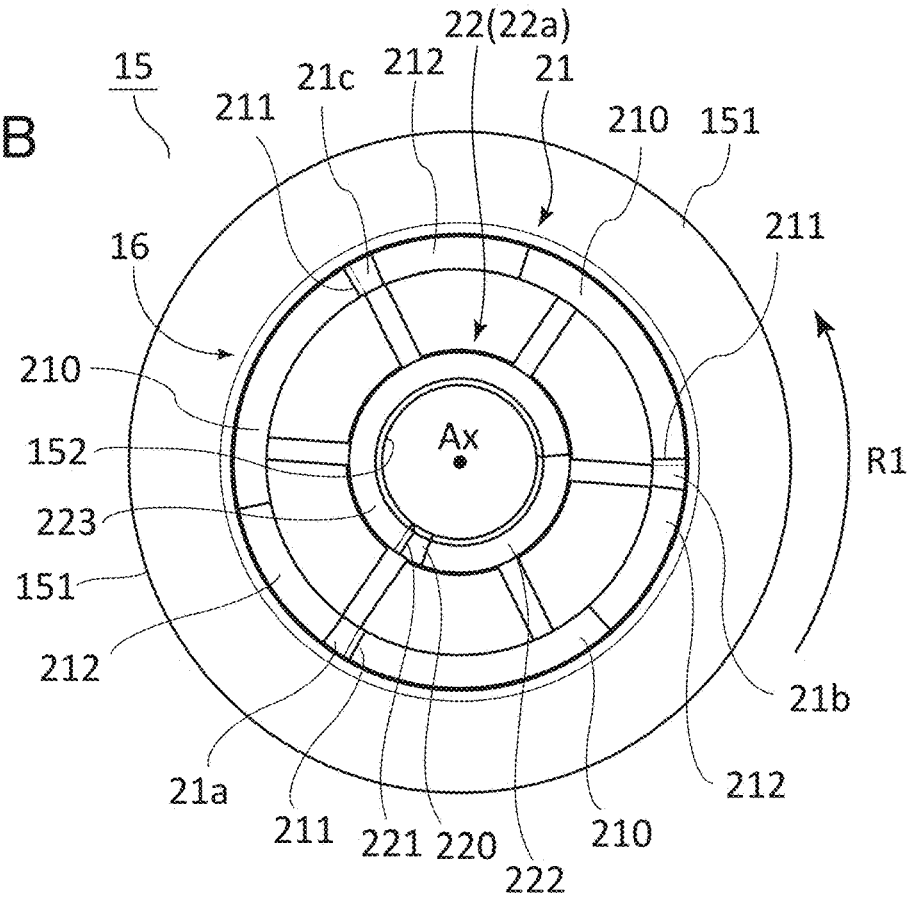
FIG. 4B is an axial direction view of the first gear according to the first embodiment.
Figure 5A:
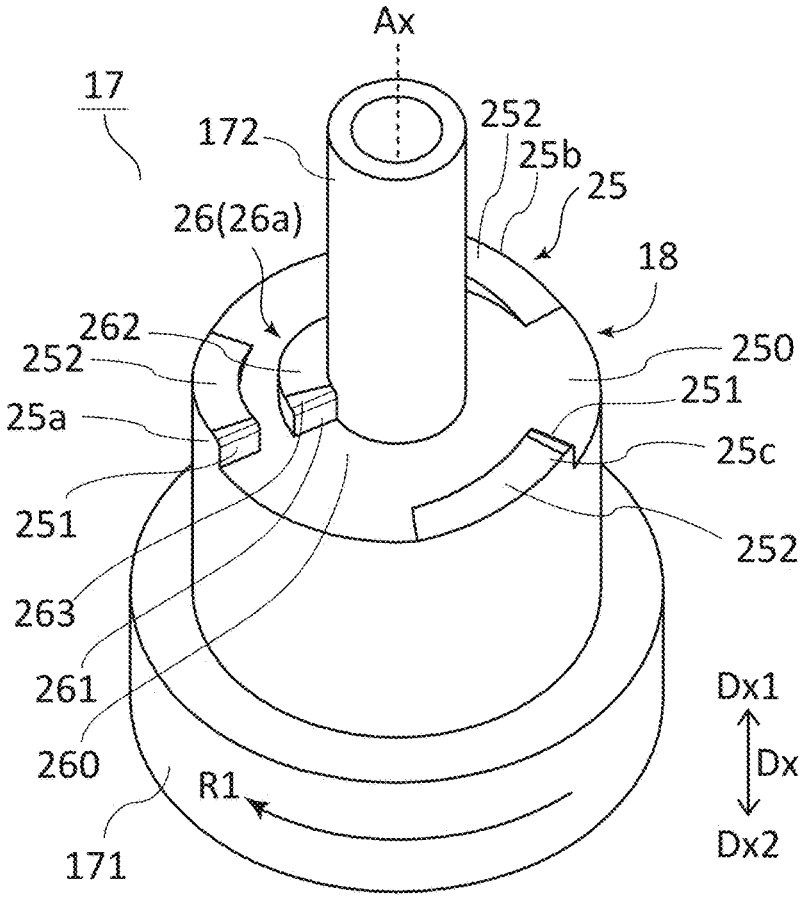
FIG. 5A is a perspective view of the first gear according to the first embodiment.
Figure 5B:
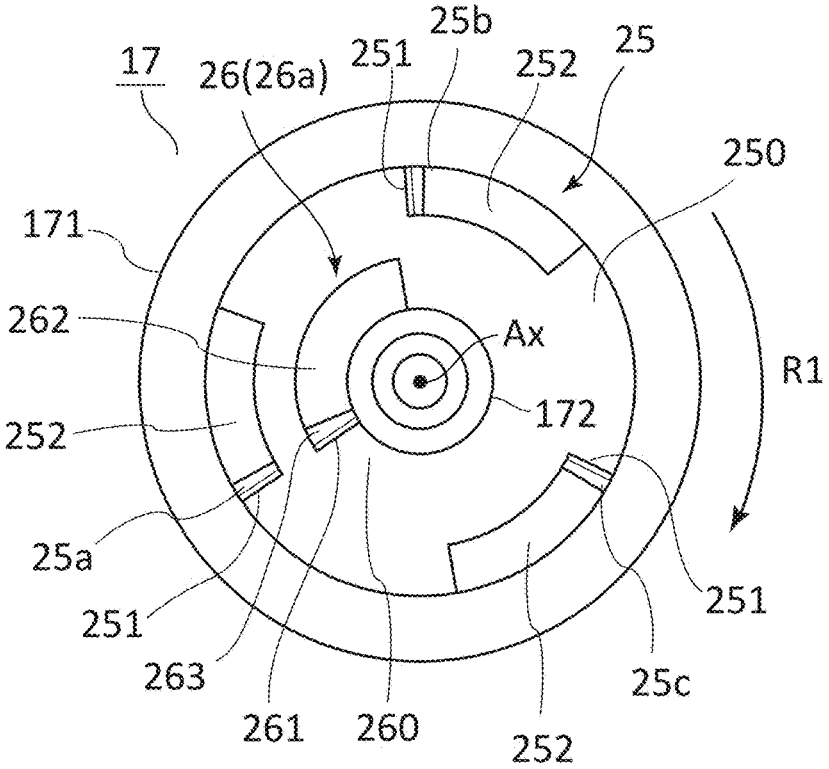
FIG. 5B is an axial direction view of the first gear according to the first embodiment.

The details of the first gear 15 and the second gear 17 will be described in detail with reference to FIGS. 4A, 4B, 5A, and 5B. FIG. 4A is a perspective view of the first gear 15, and FIG. 4B illustrates the first gear 15 as viewed from the axial-direction second side Dx2. FIG. 5A is a perspective view of the second gear 17, and FIG. 5B illustrates the second gear 17 as viewed from the axial-direction first side Dx1.

Details of First Gear

First, the first gear 15 will be described with reference to FIGS. 4A and 4B. The first ratchet portion 16 of the first gear 15 is provided on one side of the first gear 15 in the axial direction Dx (axial-direction second side Dx2, or side opposing the second gear 17).

The first ratchet portion 16 includes a first claw portion 21 and a second claw portion 22. As will be described later, whereas the first claw portion 21 has a function of transmitting the driving force of the motor 19 to the second gear 17, the second claw portion 22 has a function (cam function) of controlling the positional relationship between the first gear 15 and the second gear 17 in the axial direction Dx in cooperation with a fourth claw portion 26.

The first claw portion 21 of the present embodiment includes three claws (protrusions or ratchet teeth) 21*a*, 21*b*, and 21*c*. The three claws 21*a*, 21*b*, and 21*c* are disposed on the circumference of the same virtual circle centered on the axis Ax. In addition, the three claws 21*a*, 21*b*, and 21*c* are preferably arranged at equal intervals in the first rotational direction R1.

The first claw portion 21 of the first ratchet portion 16 has a plurality of first transmission surfaces (plurality of first transmission portions) 211, and a plurality of inclined surfaces 212. More specifically, the claws 21*a*, 21*b*, and 21*c* of the first claw portion 21 each have a first transmission surface 211 and an inclined surface 212. In each of the claws 21*a*, 21*b*, and 21*c*, the inclined surface 212 is disposed on the opposite side to the first transmission surface 211 in the first rotational direction R1. The claws 21*a*, 21*b*, and 21*c* are each formed to project to the axial-direction second side Dx2 with respect to a first base surface 210 substantially orthogonal to the axial direction Dx.

The first transmission surface 211 of each of the claws 21*a*, 21*b*, and 21*c* of the first claw portion 21 is a surface approximately orthogonal to the first base surface 210, and extends to the axial-direction second side Dx2 from the first base surface 210. In addition, as viewed in the axial direction Dx, the first transmission surface 211 extends to be orthogonal to the tangent direction of a virtual circle centered on the axis Ax. The first transmission surface 211 is a surface (first contact surface) configured to abut a second transmission surface 251 illustrated in FIG. 5A of a third claw portion 25 of the second gear 17 that will be described later.

The inclined surface 212 of each of the claws 21*a*, 21*b*, and 21*c* of the first claw portion 21 is an inclined surface having a spiral shape with the axis Ax as a central axis thereof. The inclined surface 212 is inclined with respect to the first base surface 210 such that a more downstream side thereof in the first rotational direction R1 projects more to the axial-direction second side Dx2 with respect to the first base surface 210. A downstream end portion of the inclined surface 212 in the first rotational direction R1 is coupled to an end portion of the first transmission surface 211 on the axial-direction second side Dx2.

The second claw portion 22 includes one claw (protrusion or ratchet tooth) 22*a*. That is, in the present embodiment, the number of claws of the second claw portion 22 is smaller than the number of claws of the first claw portion 21.

The claw 22*a* of the second claw portion 22 has an end surface 221, a first guide surface 222, and a separation holding surface 223. The claw 22*a* is formed to project to the axial-direction second side Dx2 with respect to a second base surface 220 substantially orthogonal to the axial direction Dx.

The end surface 221 of the claw 22*a* of the second claw portion 22 is a surface approximately orthogonal to the second base surface 220, and extends to the axial-direction second side Dx2 from the second base surface 220. An end portion of the end surface 221 on the axial-direction second side Dx2 is coupled to a downstream end of the separation holding surface 223 in the first rotational direction R1.

The first guide surface 222 of the claw 22*a* of the second claw portion 22 is an inclined surface having a spiral shape with the axis Ax as a central axis thereof. The first guide surface 222 is inclined with respect to the second base surface 220 so as to project more to the axial-direction second side Dx2 on the more downstream side in the first rotational direction R1 with respect to the second base surface 220. The downstream end of the first guide surface 222 in the first rotational direction R1 is coupled to an upstream end of the separation holding surface 223 in the first rotational direction R1. The first guide surface 222 is a surface configured to slide on a second guide surface 262 of the fourth claw portion 26 of the second gear 17 illustrated in FIG. 5A that will be described later.

The separation holding surface 223 of the claw 22*a* of the second claw portion 22 is a surface intersecting with the axial direction Dx. In the present embodiment, the separation holding surface 223 is a surface substantially orthogonal to the axial direction Dx. The separation holding surface 223 functions as a holding surface that holds the first gear 15 at the separated position. The separation holding surface 223 extends along an arc centered on the axis Ax. To reduce the number of collisions between the first gear 15 and the second gear 17 during an idling period that will be described later, the separation holding surface 223 is preferably formed in, for example, a range of 180° or more in terms of the rotational angle about the axis Ax. The separation holding surface 223 is formed at least in a range wider than the arrangement interval of the claws 21*a* to 21*c* in the first claw portion 21 in terms of the rotational angle about the axis Ax. The separation holding surface 223 of the present embodiment is formed in a range of about 240° in terms of the rotational angle about the axis Ax. The separation holding surface 223 is a surface configured to slide on a distal end surface 263 of the fourth claw portion 26 of the second gear 17 illustrated in FIG. 5A that will be described later.

As illustrated in FIG. 4B, the first claw portion 21 and the second claw portion 22 are concentrically arranged about the same axis Ax. In addition, the first claw portion 21 is disposed at a radially more outward position than the second claw portion 22. In other words, the second claw portion 22 is disposed at a radially more inward position than the first claw portion 21 in the rotational radius direction of the first gear 15 and the second gear 17.

Details of Second Gear

Next, the second gear 17 will be described with reference to FIGS. 5A and 5B. The second ratchet portion 18 of the second gear 17 is provided on one side of the second gear 17 in the axial direction Dx (axial-direction first side Dx1, or side opposing the first gear 15).

The second ratchet portion 18 includes the third claw portion 25 and the fourth claw portion 26. As will be described later, whereas the third claw portion 25 has a function of receiving the driving force of the motor 19 from the first gear 15, the fourth claw portion 26 has a function (cam function) of controlling the positional relationship between the first gear 15 and the second gear 17 in the axial direction Dx in cooperation with the second claw portion 22.

The third claw portion 25 of the present embodiment includes three claws (protrusions or ratchet teeth) 25*a*, 25*b*, and 25*c*. The three claws 25*a*, 25*b*, and 25*c* are disposed on the circumference of the same virtual circle centered on the axis Ax. In addition, the three claws 25*a*, 25*b*, and 25*c* are preferably arranged at equal intervals in the first rotational direction R1.

The third claw portion 25 of the second ratchet portion 18 has a plurality of second transmission surfaces (plurality of second transmission portions) 251, and a plurality of inclined surfaces 252. More specifically, the claws 25*a*, 25*b*, and 25*c* of the third claw portion 25 each have a second transmission surface 251 and an inclined surface 252. In each of the claws 25*a*, 25*b*, and 25*c*, the inclined surface 252 is disposed on the opposite side to the second transmission surface 251 in the first rotational direction R1. The claws 25*a*, 25*b*, and 25*c* are each formed to project to the axial-direction first side Dx1 with respect to a third base surface 250 substantially orthogonal to the axial direction Dx.

The second transmission surface 251 of each of the claws 25*a*, 25*b*, and 25*c* of the third claw portion 25 is a surface approximately orthogonal to the third base surface 250, and extends to the axial-direction first side Dx1 from the third base surface 250. In addition, as viewed in the axial direction Dx, the second transmission surface 251 extends to be orthogonal to the tangent direction of a virtual circle centered on the axis Ax. The second transmission surface 251 is a surface (second contact surface) configured to abut the first transmission surface 211 illustrated in FIG. 4A of the first claw portion 21 of the first gear 15 described above.

The inclined surface 252 of each of the claws 25*a*, 25*b*, and 25*c* of the third claw portion 25 is an inclined surface having a spiral shape with the axis Ax as a central axis thereof. The inclined surface 252 is inclined with respect to the third base surface 250 such that a more upstream side thereof in the first rotational direction R1 projects more to the axial-direction first side Dx1 with respect to the third base surface 250. An upstream end portion of the inclined surface 252 in the first rotational direction R1 is coupled to an end portion of the second transmission surface 251 on the axial-direction first side Dx1.

The fourth claw portion 26 includes one claw (protrusion or ratchet tooth) 26*a*. That is, in the present embodiment, the number of claws of the fourth claw portion 26 is smaller than the number of claws of the third claw portion 25.

The claw 26*a* of the fourth claw portion 26 has an end surface 261, a second guide surface 262, and a distal end surface 263. The claw 26*a* is formed to project to the axial-direction first side Dx1 with respect to a fourth base surface 260 substantially orthogonal to the axial direction Dx. To be noted, although the third base surface 250 and the fourth base surface 260 constitute the same flat surface in the present embodiment, the third base surface 250 and the fourth base surface 260 may be displaced from each other in the axial direction Dx.

The end surface 261 of the claw 26*a* of the fourth claw portion 26 is a surface approximately orthogonal to the fourth base surface 260, and extends to the axial-direction first side Dx1 from the fourth base surface 260. An end portion of the end surface 261 on the axial-direction first side Dx1 is coupled to the distal end surface 263.

The second guide surface 262 of the claw 26*a* of the fourth claw portion 26 is an inclined surface having a spiral shape with the axis Ax as a central axis thereof. The second guide surface 262 is inclined with respect to the fourth base surface 260 so as to project more to the axial-direction first side Dx1 on the more upstream side in the first rotational direction R1 with respect to the fourth base surface 260. The inclination of the second guide surface 262 is preferably equal to the inclination of the first guide surface 222 illustrated in FIG. 4A described above. The upstream end of the second guide surface 262 in the first rotational direction R1 is coupled to the distal end surface 263. The second guide surface 262 is a surface configured to slide on the first guide surface 222 of the second claw portion 22 of the first gear 15 illustrated in FIG. 4A described above.

The distal end surface 263 of the claw 26*a* of the fourth claw portion 26 is a surface substantially orthogonal to the axial direction Dx. The distal end surface 263 is a surface that slides on the separation holding surface 223 of the second claw portion 22 of the first gear 15 illustrated in FIG. 4A described above.

As illustrated in FIG. 5B, the third claw portion 25 and the fourth claw portion 26 are concentrically arranged about the same axis Ax. In addition, the third claw portion 25 is disposed at a radially more outward position than the fourth claw portion 26. In other words, the fourth claw portion 26 is disposed at a radially more inward position than the third claw portion 25 in the rotational radius direction of the first gear 15 and the second gear 17.

Operation of Ratchet Mechanism Portion

The operation of the ratchet mechanism portion 19R will be described. In the description below, a state or period in which the first gear 15 is rotationally driven in the first rotational direction R1 by the driving force of the motor 19 illustrated in FIG. 2 will be referred to as a "drive transmission state of the ratchet mechanism portion 19R" or a "drive transmission period of the ratchet mechanism portion 19R". A state or period in which the second gear 17 is rotated in the first rotational direction R1 as a result of the sheet being pulled out from the conveyance roller 14 in the sheet conveyance direction Ds illustrated in FIG. 1 in a state in which the motor 19 is stopped will be referred to as an "idling state of the ratchet mechanism portion 19R", or an "idling period of the ratchet mechanism portion 19R" In other words, the drive transmission state is a state of the ratchet mechanism portion 19R when the conveyance roller 14 to which the driving force of the motor 19 is input conveys the sheet, and the idling state is a state of the ratchet mechanism portion 19R when the conveyance roller 14 is rotated by receiving a sheet pull-out force from the user via the sheet in a state in which the motor 19 is stopped.

Figure 6A:
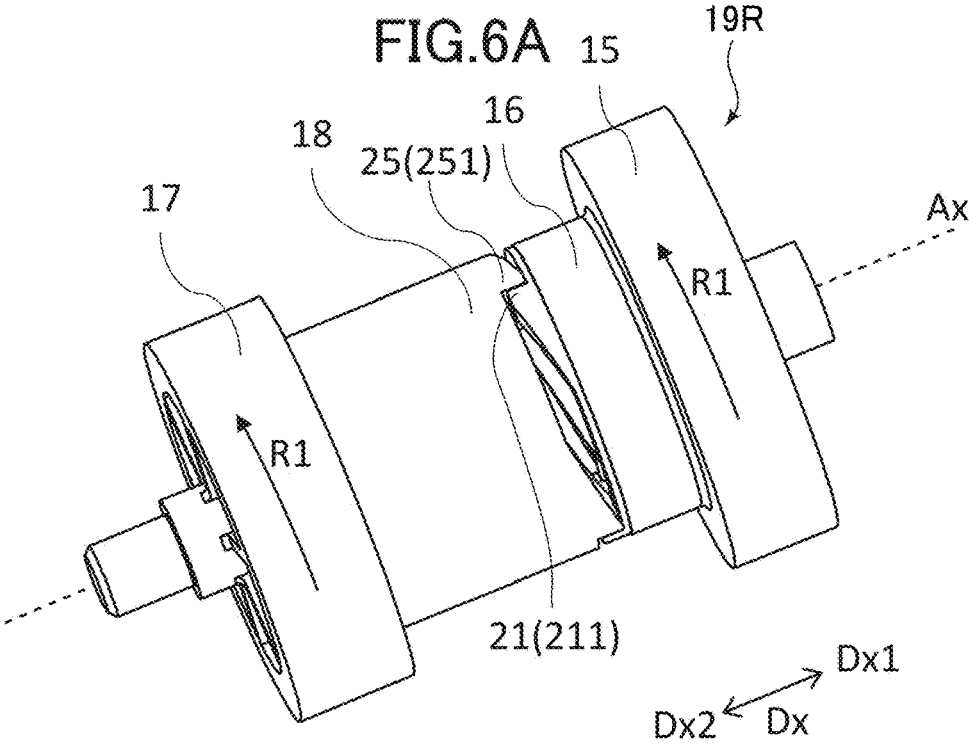
FIGS. 6A and 6B are each a diagram for describing the operation of the ratchet mechanism portion according to the first embodiment.
Figure 6B:
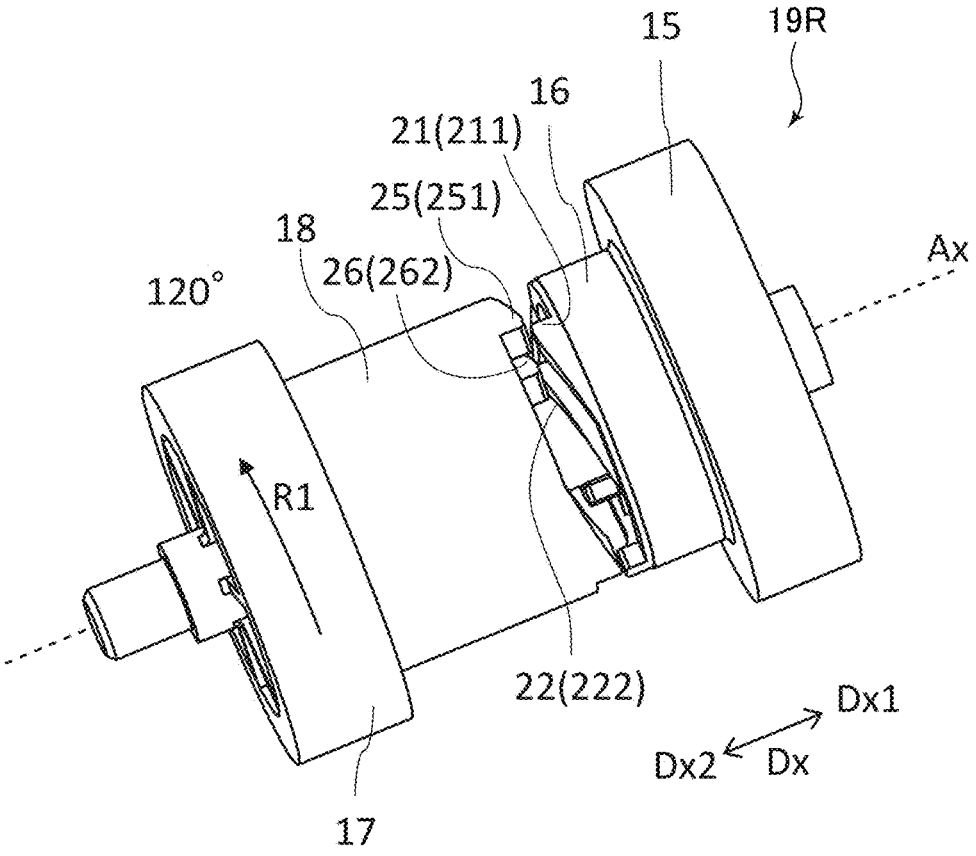

FIG. 6A is a perspective view of the ratchet mechanism portion 19R in the drive transmission state. FIG. 6B is a perspective view of the ratchet mechanism portion 19R in the idling state.

As described above, in the present embodiment, the first gear 15 is movable between the meshing position (engaged position) and the separated position in the axial direction Dx. In the drive transmission state illustrated in FIG. 6A, the first gear 15 is positioned at the meshing position. In addition, as will be described in detail later with reference to FIGS. 7A and 7B, the first gear 15 is moved from the meshing position to the separated position while the second gear 17 rotates by a predetermined angle after the drive transmission state is switched to the idling state.

The first gear 15 is positioned in the meshing position in FIG. 6A, and is positioned in the separated position in FIG. 6B. The meshing position of the first gear 15 is a position of the first gear 15 in the axial direction Dx when the first transmission surfaces 211 of the first claw portion 21 of the first ratchet portion 16 are meshed with the second transmission surfaces 251 of the third claw portion 25 of the second ratchet portion 18. The separated position of the first gear 15 is a position of the first gear 15 in the axial direction Dx when the first transmission surfaces 211 of the first ratchet portion 16 are separated from the second transmission surfaces 251 of the second ratchet portion 18 in the axial direction Dx. In other words, the meshing position is a position of the first gear 15 at which the positions of the first transmission surfaces 211 in the axial direction Dx and the positions of the second transmission surfaces 251 in the axial direction Dx overlap with each other. In addition, the separated position is a position of the first gear 15 at which the positions of the first transmission surfaces 211 in the axial direction Dx and the positions of the second transmission surfaces 251 in the axial direction Dx do not overlap with each other.

When the first gear 15 is at the meshing position, the first claw portion 21 of the first ratchet portion 16 and the third claw portion 25 of the second ratchet portion 18 can engage with each other. That is, the first transmission surface 211 of each claw of the first claw portion 21 can come into contact (engage) with the second transmission surface 251 of each claw of the third claw portion 25. When the first gear 15 is at the separated position, the first claw portion 21 and the third claw portion 25 are separated from each other in the axial direction Dx.

Figure 7A:
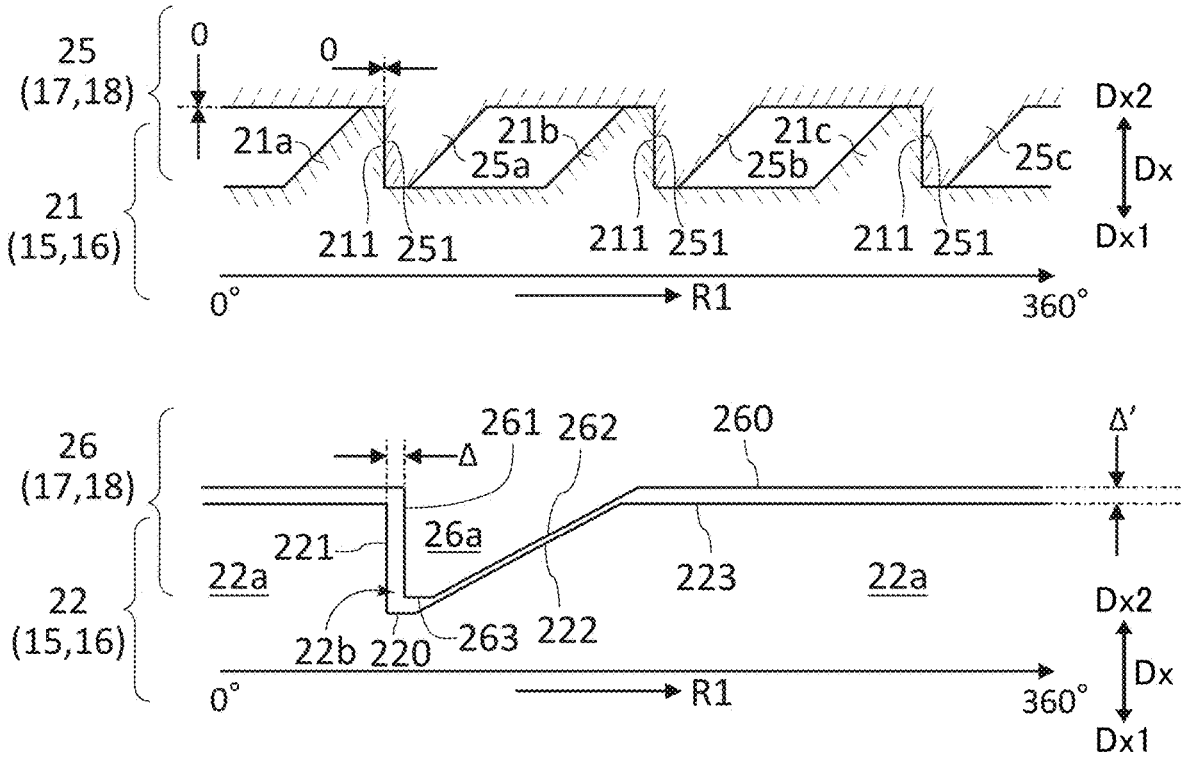
FIGS. 7A and 7B are each a diagram for describing the operation of the ratchet mechanism portion according to the first embodiment.
Figure 7B:
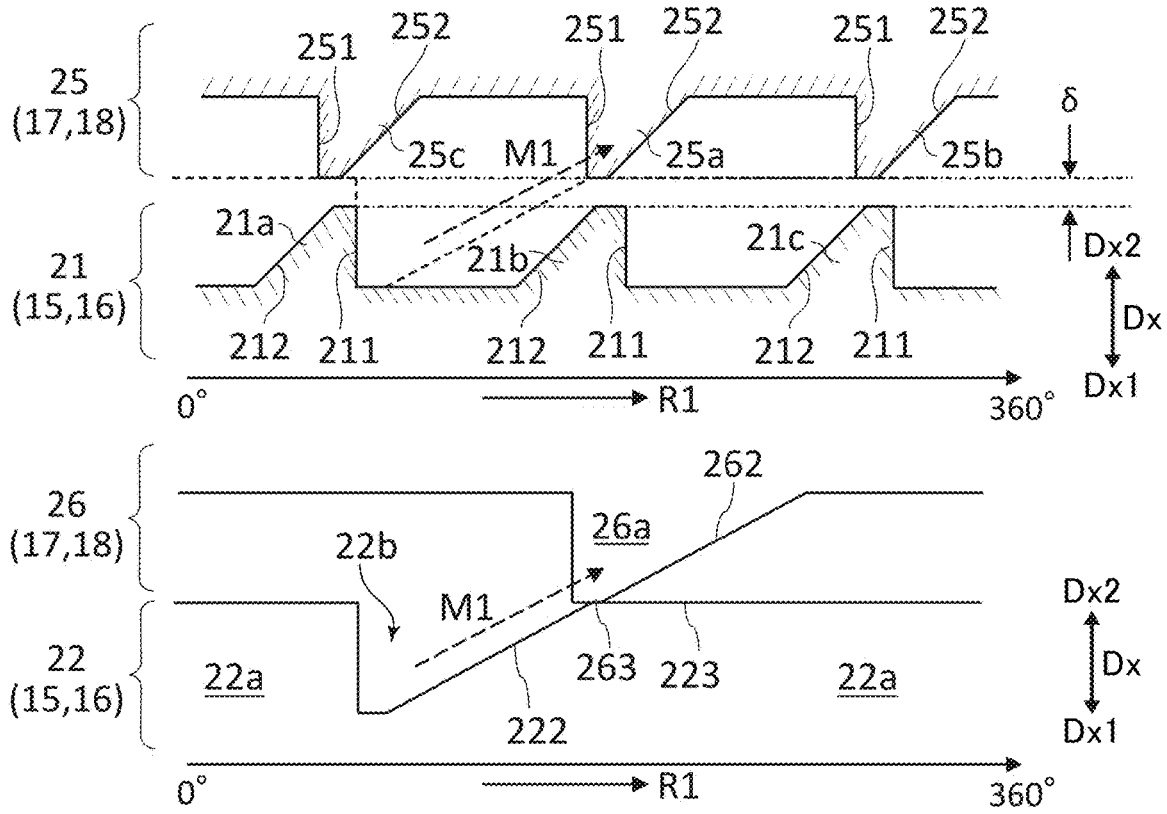

The operation of the ratchet mechanism portion 19R in the drive transmission state and the idling state will be described further with reference to FIGS. 7A and 7B. FIG. 7A is a schematic diagram illustrating the positional relationship between the first ratchet portion 16 and the second ratchet portion 18 in the drive transmission state. FIG. 7B is a schematic diagram illustrating the positional relationship between the first ratchet portion 16 and the second ratchet portion 18 in the idling state. The upper portion of each of FIGS. 7A and 7B illustrates the cross-section of a virtual cylindrical surface of the ratchet mechanism portion 19R passing through the first claw portion 21 of the first ratchet portion 16 and the third claw portion 25 of the second ratchet portion 18 projected onto a flat plane. The lower portion of each of FIGS. 7A and 7B illustrates the cross-section of a virtual cylindrical surface of the ratchet mechanism portion 19R passing through the second claw portion 22 of the first ratchet portion 16 and the fourth claw portion 26 of the second ratchet portion 18 projected onto a flat plane.

To be noted, the horizontal axis of each of FIGS. 7A and 7B represents the rotational angle of the first rotational direction R1 about the axis Ax with respect to a predetermined portion of the first ratchet portion 16. In addition, "0" in these diagrams indicates that the surfaces are in contact with each other (the gap is set to 0).

Drive Transmission State

As illustrated in the upper portion of FIG. 7A, the first gear 15 is positioned at the meshing position in the drive transmission state. The first transmission surface 211 of each of the claws 21*a*, 21*b*, and 21*c* of the first claw portion 21 comes into contact with the second transmission surface 251 of each of the claws 25*a*, 25*b*, and 25*c* of the third claw portion 25. Therefore, the ratchet mechanism portion 19R can transmit the torque (driving force) in the first rotational direction R1 from the first gear 15 and the second gear 17 via the engagement between the first transmission surface 211 and the second transmission surface 251.

The first claw portion 21 and the third claw portion 25 each have three claws. Therefore, in the present embodiment, the number of engagement surfaces (contact portions or contact surfaces) where the plurality of first claws and the plurality of third claws come into contact with each other during the drive transmission period is 3.

As illustrated in the lower portion of FIG. 7A, the downstream end surface 221 of the claw 22*a* of the second claw portion 22 in the first rotational direction R1 and the upstream end surface 261 of the claw 26*a* of the fourth claw portion 26 in the first rotational direction R1 are disposed so as not to come into contact with each other in the drive transmission state. In the present embodiment, in the drive transmission state, a gap Δ is present between the end surface 221 and the end surface 261. This gap Δ is set to, for example, 4° in terms of the rotational angle about the axis Ax.

In addition, in the drive transmission state, a gap Δ' in the axial direction Dx is also present between the separation holding surface 223 of the second claw portion 22 and the fourth base surface 260 and between the second base surface 220 and the distal end surface 263 of the fourth claw portion 26.

By providing the gaps Δ and Δ' described above, in the drive transmission state, the driving force can be transmitted via the engagement between the first transmission surfaces 211 of the first claw portion 21 and the second transmission surfaces 251 of the third claw portion 25 without the second claw portion 22 and the fourth claw portion 26 contributing to the drive transmission.

As illustrated in the lower portion of FIG. 7A, in the drive transmission state, the claw 26*a* of the fourth claw portion 26 of the second ratchet portion 18 fits in a recess portion 22*b* of the second claw portion 22 of the first ratchet portion 16, and thus the first gear 15 is allowed to be positioned at the meshing position. The recess portion 22*b* is a space between the first guide surface 222 and the end surface 221 of the second claw portion 22, and is a space more recessed to the axial-direction first side Dx1 than the separation holding surface 223. As a result of the recess portion 22*b* of the second claw portion 22 accepting the claw 26*a* of the fourth claw portion 26, the first gear 15 can be positioned at the meshing position that is more on the axial-direction second side Dx2 than the separated position illustrated in FIG. 7B in accordance with the urging force of the urging spring 20. In other words, in the case where the relative rotational angle between the first gear 15 and the second gear 17 is such an angle that the claw 26*a* of the fourth claw portion 26 fits in the recess portion 22*b* of the second claw portion 22, the first gear 15 can be positioned at the meshing position.

In the present embodiment, the number of the claw 26*a* of the fourth claw portion 26 and the number of the recess portion 22*b* of the second claw portion 22 are each 1. Therefore, among the relative rotational angles between the first gear 15 and the second gear 17, the first gear 15 can be positioned at the meshing position at only one angle.

Idling State

When the sheet is pulled out from the conveyance roller 14 in a state in which the motor 19 is stopped, the second gear 17 receives a torque in the first rotational direction R1 by the sheet pull-out force. Meanwhile, since the first gear 15 is coupled to the gear train 191 and the motor 19 illustrated in FIG. 2 that is not receiving power supply, the first gear 15 is prone to staying at the current position without rotating in the first rotational direction R1. Therefore, the second gear 17 rotates in the first rotational direction R1 with respect to the first gear 15.

At this time, as illustrated in the lower portion of FIG. 7B, the first guide surface 222 of the second claw portion 22 of the first gear 15 slides on the second guide surface 262 of the fourth claw portion 26 of the second gear 17. As a result of this, as the second gear 17 rotates in the first rotational direction R1, the first gear 15 and the second gear 17 relatively move to separate from each other in the axial direction Dx by following the inclination of the first guide surface 222 and the second guide surface 262. In the present embodiment, the first gear 15 is moved to the axial-direction first side Dx1 as the second gear 17 rotates in the first rotational direction R1.

To be noted, the inclination of the first guide surface 222 (angle with respect to a plane orthogonal to the axial direction Dx) is smaller than the inclination of the inclined surface 212 (first inclined surface) of the claws of the first claw portion 21, or the inclination of the second guide surface 262 is smaller than the inclination of the inclined surface 252 (second inclined surface) of the claws of the third claw portion 25. As a result of this, as compared with a configuration in which the first guide surface 222 and the second guide surface 262 are not provided and movement of the first gear 15 to the axial-direction first side Dx1 is caused by sliding between the inclined surface 212 and the inclined surface 252, the resistance torque that the second gear 17 receives from the first gear 15 can be reduced. That is, in the case where the inclination of the first guide surface 222 and the inclination of the second guide surface 262 are small, the direction of the forces of the first guide surface 222 and the second guide surface 262 pushing each other (normal direction of the first guide surface 222 and the second guide surface 262) is close to the axial direction Dx. Therefore, even in the case where the sheet pull-out force is relatively small, the first gear 15 easily moves to the axial-direction first side Dx1.

While the first guide surface 222 and the second guide surface 262 slide on each other, the first gear 15 moves from the meshing position illustrated in FIG. 6A to the separated position illustrated in FIG. 6B in the axial direction Dx. As a result of this, as illustrated in the upper portion of FIG. 7B, the claws 21*a*, 21*b*, and 21*c* of the first claw portion 21 are separated from the claws 25*a*, 25*b*, and 25*c* of the third claw portion 25 in the axial direction Dx. That is, the first gear 15 is retracted from the meshing position to the separated position by the sliding between the first guide surface 222 and the second guide surface 262. That is, during the idling period, one of the first member and the second member retracts from the meshing position to the separated position against the urging force of the urging portion due to the sliding between the first guide surface and the second guide surface. As a result of this, the second gear 17 is allowed to rotate in the first rotational direction R1 with respect to the first gear 15 without interference between the first claw portion 21 and the third claw portion 25.

In the present embodiment, the first gear 15 moves (retracts) from the meshing position to the separated position while the second gear 17 rotates in the first rotational direction R1 by about 120° with respect to the drive transmission state illustrated in FIG. 7A.

In the case where the second gear 17 rotates by more than 120° in the first rotational direction R1 with respect to the drive transmission state, the separation holding surface 223 of the second claw portion 22 and the distal end surface 263 of the fourth claw portion 26 starts being in contact with each other instead of the first guide surface 222 and the second guide surface 262 as illustrated in the lower portion of FIG. 7B. After this, while the separation holding surface 223 and the distal end surface 263 of the fourth claw portion 26 slide on each other, the second gear 17 rotates in the first rotational direction R1 in a state in which the first gear 15 is held at the separated position.

Then, in the case where the second gear 17 has rotated by 360° in the first rotational direction R1 with respect to the drive transmission state illustrated in FIG. 7A, the claw 26*a* of the fourth claw portion 26 opposes the recess portion 22*b* of the second claw portion 22 again. In this case, the first gear 15 starts moving from the separated position to the meshing position by the urging force of the urging spring 20. However, when the first guide surface 222 and the second guide surface 262 come into contact with each other, the first gear 15 is moved back to the separated position in accordance with the rotation of the second gear 17. As described above, in the present embodiment, the first guide surface 222 and the second guide surface 262 come into contact (collide) with each other once each time the second gear 17 rotates once while the sheet is pulled out.

Incidentally, the first claw portion 21 is configured not to come into contact with the third claw portion 25 in the idling state of the ratchet mechanism portion 19R. The first claw portion 21 and the third claw portion 25 preferably do not come into contact with each other for the entirety of the period in which the first guide surface 222 and the second guide surface 262 slide on each other and the period in which the separation holding surface 223 and the distal end surface 263 of the fourth claw portion 26 slide on each other.

Specifically, the first guide surface 222 and the second guide surface 262 are formed such that the movement amount in the axial direction Dx of retraction of the first gear 15 from the meshing position to the separated position in the axial direction Dx is larger than the width in the axial direction Dx of each engagement surface where one of the first transmission surfaces 211 and one of the second transmission surfaces 251 come into contact with each other (engagement depth between the first claw portion 21 and the third claw portion 25). In the case where the difference between the above-described movement amount of the first gear 15 and the engagement depth between the first claw portion 21 and the third claw portion 25 is δ, for example, δ is set to 0.5 (mm). Therefore, a gap δ is present between the first claw portion 21 and the third claw portion 25 in the axial direction Dx in a state in which the first gear 15 is positioned at the separated position as illustrated in FIG. 7B.

In addition, as illustrated in the lower portion of FIG. 7B, when the first gear 15 and the second gear 17 relatively move due to the sliding between the first guide surface 222 and the second guide surface 262, the third claw portion 25 relatively moves in a predetermined movement direction M1 with respect to the first claw portion 21. The first claw portion 21 and the third claw portion 25 are disposed such that the movement trajectory of the third claw portion 25 moving in the movement direction M1 does not interfere with the first claw portion 21 of the first gear 15 at this time. Specifically, in the present embodiment, the claws 21*a* to 21*c* of the first claw portion 21 and the claws 25*a* to 25*c* of the third claw portion 25 are arranged at intervals in a rotational direction about the axis Ax. In addition, the inclination of the inclined surfaces 212 and 252 of the claws 21*a* to 21*c* and 25*a* to 25*c* is set to be steeper than the inclination of the first guide surface 222 and the second guide surface 262 with respect to the movement direction M1. As a result of this, even in the case where the third claw portion 25 relatively moves with respect to the first claw portion 21 due to the sliding between the first guide surface 222 and the second guide surface 262, contact between the inclined surfaces 252 of the third claw portion 25 and the inclined surfaces 212 of the first claw portion 21 can be avoided. To be noted, the arrangement interval between the claws and the inclination, shape, and the like of the inclined surfaces 212 and 252 may be modified as long as the third claw portion 25 and the first claw portion 21 are formed so as not to interfere with each other during the sliding between the first guide surface 222 and the second guide surface 262.

According to the configuration described above, in the idling state, the second claw portion 22 and the fourth claw portion 26 come into contact with each other, and the first claw portion 21 and the third claw portion 25 do not come into contact with each other.

Merits of Present Embodiment

As described above, in the drive transmission state, the driving force is transmitted from the first gear 15 to the second gear 17 by the first claw portion 21 and the third claw portion 25. As a result of this, in the idling state, the position of the first gear 15 in the axial direction Dx is controlled by the sliding between the second claw portion 22 and the fourth claw portion 26. That is, a function-separated configuration in which a shape (first claw portion 21 and third claw portion 25) having a function of transmitting the driving force of the drive source from the first gear 15 to the second gear 17 and a shape (second claw portion 22 and fourth claw portion 26) having a function of controlling the positional relationship in the axial direction Dx between the first gear 15 and the second gear 17 are provided separately is employed. As a result of this, for example, the following merits can be obtained.

(1) Durability of Claw Portions and Sound of Collision During Idling Period

To improve the durability of the claw portions of the ratchet mechanism by reducing the stress acting on the claw portions during a drive transmission period, it is effective to disperse the load by increasing the number of claws of the claw portions (the number of teeth of the ratchet teeth). However, if the number of claws is increased, there is a risk that the number of collisions between the claws during an idling period of the ratchet mechanism also increases, and thus the sound of collision becomes louder.

In contrast, in the present embodiment, the separation holding surface 223 serving as a holding surface that holds the first gear 15 at the separated position during the idling period after the first gear 15 has retracted from the meshing position to the separated position due to the sliding between the first guide surface 222 and the second guide surface 262 is provided. The separation holding surface 223 holds the first gear 15 at the separated position after the first gear 15 is retracted from the meshing position to the separated position. As a result of this, the movement of the first gear 15 from the separated position to the meshing position is restricted until the second gear 17 rotates by 360° with respect to the drive transmission state illustrated in FIG. 7B. Therefore, in the present embodiment, the number of times the first gear 15 moves from the separated position to the meshing position while the second gear 17 rotates once in the first rotational direction R1 with respect to the first gear 15 is suppressed to one. That is, in the present embodiment, the number of times of occurrence of a sound of collision caused by collision between the first guide surface 222 and the second guide surface 262 is only one per one rotation of the second gear 17 in the idling state.

In contrast, in the present embodiment, the driving force is transmitted via engagement between a plurality of claws provided separately from the separation holding surfaces 223 and 226 in the drive transmission state. In the present embodiment, the number of engagement surfaces at which the plurality of claws 21*a* to 21*c* (plurality of first claws) of the first claw portion 21 and the plurality of claws 25*a* to 25*c* (plurality of first claws) of the third claw portion 25 come into contact with each other during the drive transmission period is 3. In addition, the plurality of first transmission surfaces 211 and the plurality of second transmission surfaces 251 come into contact with each other at a plurality of contact positions in the first rotational direction R1. In the present embodiment, the number of contact positions included in the plurality of contact positions is 3.

As described above, the number of times the holding surface allows one of the first member and the second member to move from the separated position to the meshing position while the second member rotates once in a predetermined rotational direction with respect to the first member is smaller than the number of engagement surfaces at which the first transmission surface and the second transmission surface come into contact with each other during the drive transmission period. In addition, as described above, the number of times the holding surface allows the one of the first member and the second member to move from the separated position to the meshing position while the second member rotates once with respect to the first member is smaller than the number of contact positions included in the plurality of contact positions during the drive transmission period. As a result of this, the number of collisions between claws during the idling period can be reduced to reduce the sound of collision while improving the durability of the claw portion by increasing the number of claws.

In addition, the number of times the first gear 15 moving to the meshing position while the second gear 17 rotates once in the idling state means that the frequency of occurrence of a work of returning the first gear 15 to the separated position against the urging force of the urging spring 20 is low. Therefore, the energy (amount of work) for the user to pull out the sheet from the conveyance roller 14 can be reduced, and thus a jam removal process can be made easier.

To be noted, to obtain the above-described merit, a configuration in which, for example, the first guide surface 222 and the second guide surface 262 are at more outward positions than the first transmission surfaces 211 and the second transmission surfaces 251 in the rotational radius direction of the first gear 15 may be employed unlike (2) described below.

In addition, the holding surface (separation holding surface) may be provided on the fourth claw portion 26. That is, the holding surface may be provided on at least one of the second claw portion and the fourth claw portion, and configured to hold one of the first member and the second member at the separated position by the sliding on the other of the second claw portion and the fourth claw portion. That is, at least one of the first ratchet portion 16 and the second ratchet portion 18 has the holding surface. The holding surface holds one of the first gear 15 and the second gear 17 at the separated position by sliding on the other of the first ratchet portion 16 and the second ratchet portion 18.

(2) Durability of Claw Portion and Sheet Pull-Out Force

To reduce the stress acting on the first claw portion 21 and the third claw portion 25 during the drive transmission period and improve the durability, it is effective to dispose the first claw portion 21 and the third claw portion 25 at positions as far as possible from the axis Ax. This is because if the magnitude of torque transmitted from the first gear 15 to the second gear 17 during the drive transmission period is the same, the force of the first transmission surface 211 and the second transmission surface 251 pushing each other is smaller in the case where the first transmission surface 211 and the second transmission surface 251 are farther from the axis Ax.

Meanwhile, if the first guide surface 222 and the second guide surface 262 are on the same circumference as the first transmission surfaces 211 and the second transmission surfaces 251, the sheet pull-out force for the jam removal process is larger in the case where the first transmission surfaces 211 and the second transmission surfaces 251 are farther from the axis Ax. This is because at least part of the sheet pull-out force is derived from the frictional force of the sliding between the first guide surface 222 and the second guide surface 262. That is, this is because even when the frictional force is the same, the resistance torque that the second gear 17 receives due to the frictional force is larger in the case where the first guide surface 222 and the second guide surface 262 serving as an action point of the frictional force are farther from the axis Ax.

According to the present embodiment, at least part of the engagement surface between the first transmission surfaces 211 and the second transmission surfaces 251 during the drive transmission period is at a more outward position than the sliding surface between the first guide surface 222 and the second guide surface 262 during the idling period in the rotational radius direction of the first gear 15. As a result of this, the force acting on the engagement surface between the claw portions during the drive transmission period can be reduced, and thus the durability of the first claw portion 21 and the third claw portion 25 can be improved. In addition, the resistance torque that the second gear 17 receives from the frictional force of the sliding between the first guide surface 222 and the second guide surface 262 can be reduced, and thus the sheet pull-out force for the jam removal process can be reduced.

Further, according to the present embodiment, in the rotational radius direction described above, the entirety of the first claw portion 21 (entirety of the first transmission surfaces 211) is at a more outward position than the first guide surface 222 and the second guide surface 262. In addition, in the rotational radius direction described above, the entirety of the third claw portion 25 (entirety of the second transmission surface 251) is at a more outward position than the first guide surface 222 and the second guide surface 262. As a result of this, improvement of the durability of the first claw portion 21 and the third claw portion 25 and reduction of the sheet pull-out force during the jam removal process can be achieved simultaneously at a high level.

In addition, according to the present embodiment, at least part of the engagement surface between the first transmission surfaces 211 and the second transmission surfaces 251 during the drive transmission period is at a more outward position than the sliding surface between the separation holding surface 223 and the distal end surface 263 of the fourth claw portion 26 during the idling period. Therefore, the resistance torque that the second gear 17 receives from the frictional force of the sliding between the separation holding surface 223 and the distal end surface 263 of the fourth claw portion 26 can be reduced, and thus the sheet pull-out force for the jam removal process can be reduced.

Further, in the rotational radius direction described above, the entirety of the first claw portion 21 (entirety of the first transmission surfaces 211) is at a more outward position than the separation holding surface 223. In addition, in the rotational radius direction described above, the entirety of the third claw portion 25 (entirety of the second transmission surfaces 251) is at a more outward position than the separation holding surface 223. As a result of this, improvement of the durability of the first claw portion 21 and the third claw portion 25 and reduction of the sheet pull-out force for the jam removal process can be achieved simultaneously at a high level.

To be noted, to obtain the merit described above, for example, the number of the claws of the first claw portion 21 and the number of the claws of the third claw portion 25 may be each 1 unlike (1) described above.

MODIFICATION EXAMPLES

In the first embodiment, a configuration in which the number of the engagement surfaces between the first claw portion 21 and the third claw portion 25 during the drive transmission period is 3 and the number of times the first gear 15 moves from the separated position to the meshing position while the second gear 17 rotates once in the first rotational direction R1 with respect to the first gear 15 is 1 has been described. The number of times is not limited to this, and the merit described in (1) above can be obtained as long as the number of the engagement surfaces is larger than the number of times the first gear 15 moves from the separated position to the meshing position while the second gear 17 rotates once in the first rotational direction R1 with respect to the first gear 15.

In the first embodiment, a configuration in which the separation holding surface 223 is provided in the second claw portion 22 has been described. The configuration is not limited to this, and for example, the distal end surface 263 of the fourth claw portion 26 may be extended along an arc centered on the axis Ax to serve as the separation holding surface. In this case, the separation holding surface 223 of the second claw portion 22 can be shortened in accordance with the length of the separation holding surface of the fourth claw portion 26. An operation substantially the same as the first embodiment can be realized if the sum of the range in which the separation holding surface 223 of the second claw portion 22 is formed and the range in which the separation holding surface of the fourth claw portion 26 is formed is about 240° in terms of the rotational angle about the axis Ax.

In the first embodiment, a configuration in which the first guide surface 222 and the second guide surface 262 are each constituted by an inclined surface having the same inclination and come into surface contact with each other at the time of sliding has been described. The configuration is not limited to this, and if one of the first guide surface 222 and the second guide surface 262 is the inclined surface described in the first embodiment (cam surface), an operation substantially the same as the first embodiment can be realized even in the case where the other of the first guide surface 222 and the second guide surface 262 (cam follower) has a shape different from the first embodiment. In addition, a part where the first transmission surface 211, the second transmission surface 251, the first guide surface 222, the second guide surface 262, or the separation holding surface 223 is provided may be a recess portion recessed with respect to the side surface of the first gear 15 or the second gear 17 instead of a claw shape (protrusion).

Second Embodiment

A configuration according to a second embodiment will be described. In the description below, it is assumed that elements denoted by the same reference signs as in the first embodiment have substantially the same configurations and functions as those described in the first embodiment unless otherwise described, and parts different from the first embodiment will be mainly described.

In the present embodiment, the shapes of the first gear 15 and the second gear 17 are different from the first embodiment. The basic configuration of the ratchet mechanism portion 19R including the first gear 15 and the second gear 17 illustrated in FIG. 3, and the configuration of the sheet conveyance apparatus illustrated in FIG. 2 including the ratchet mechanism portion 19R and the configuration of the image forming apparatus illustrated in FIG. 1 can be set to those described in the first embodiment.

Figure 8A:
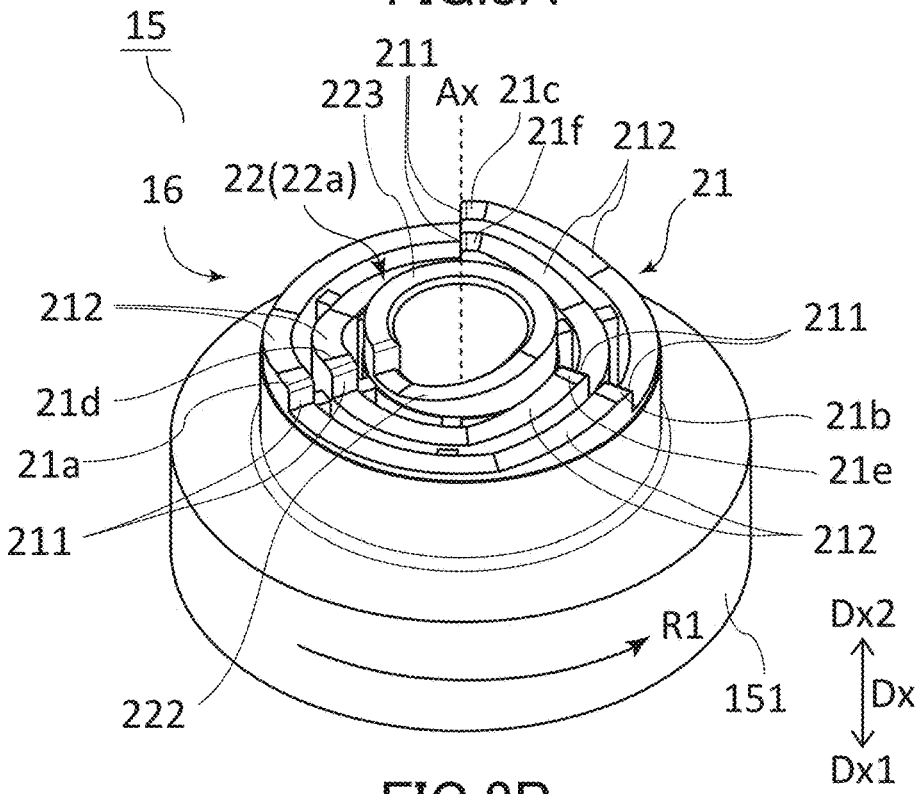
FIG. 8A is a perspective view of a first gear according to a second embodiment.
Figure 8B:
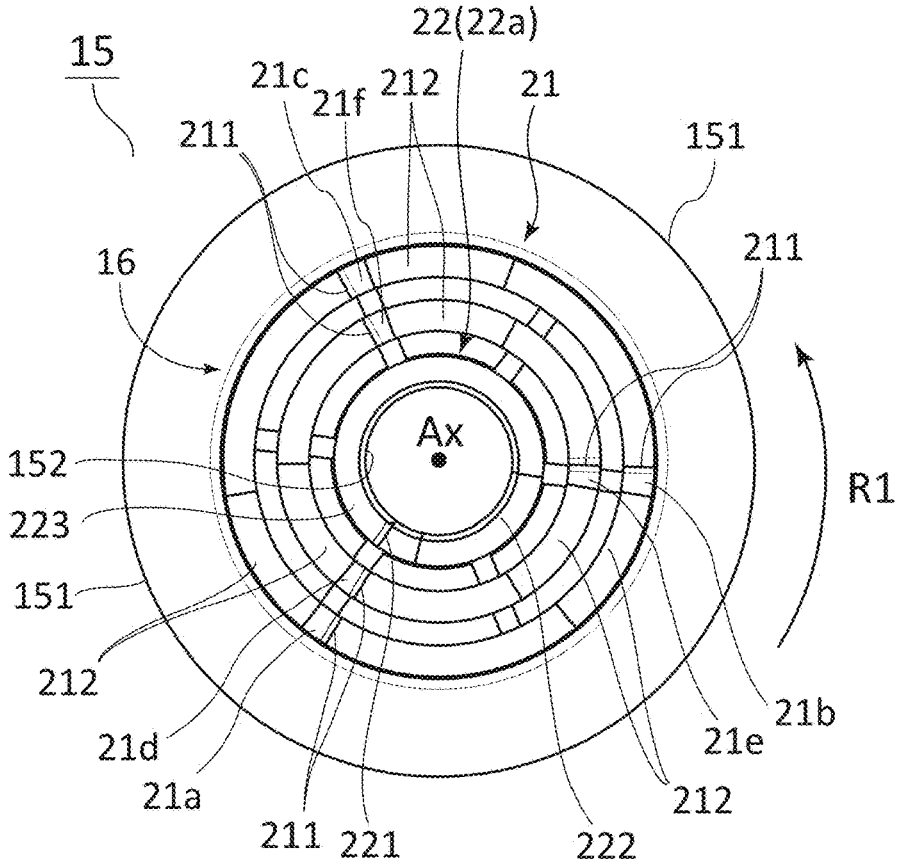
FIG. 8B is an axial direction view of the first gear according to the second embodiment.
Figure 9A:
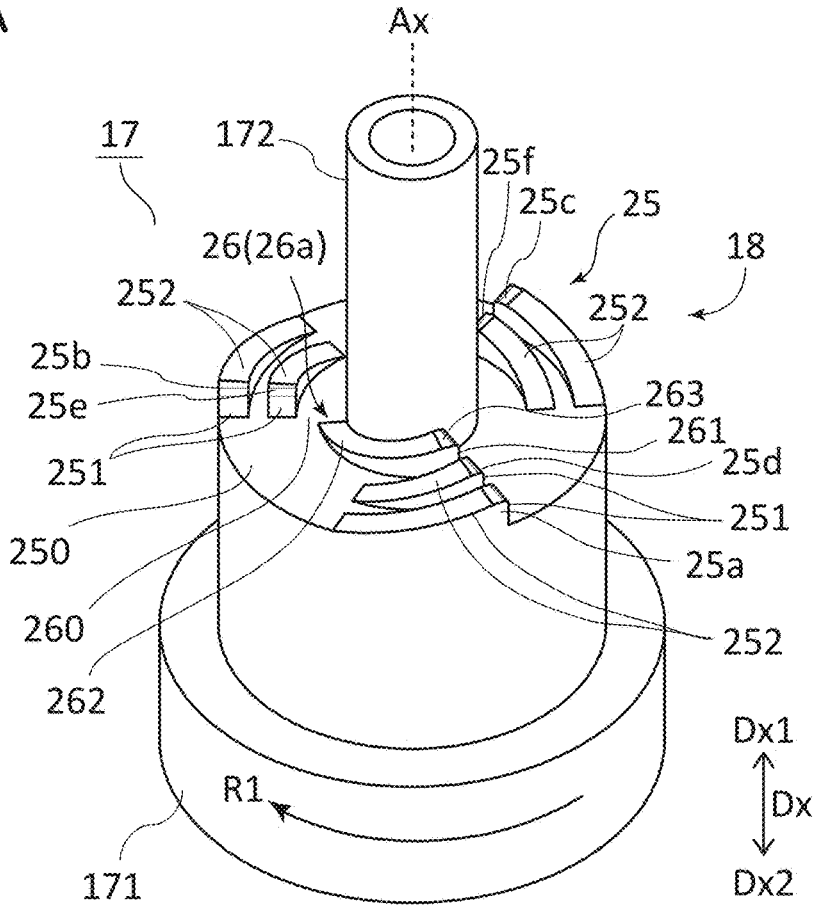
FIG. 9A is a perspective view of the first gear according to the second embodiment.
Figure 9B:
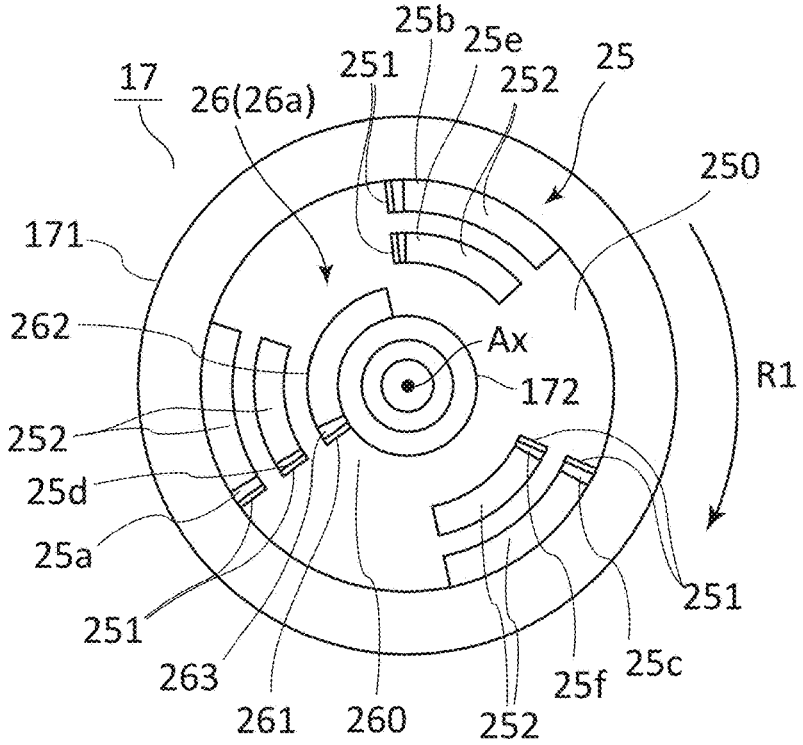
FIG. 9B is an axial direction view of the first gear according to the second embodiment.

In the description below, details of the first gear 15 and the second gear 17 will be further described with reference to FIGS. 8A, 8B, 9A, and 9B. FIG. 8A is a perspective view of the first gear 15, and FIG. 8B is a diagram illustrating the first gear 15 as viewed from the axial-direction second side Dx2. FIG. 9A is a perspective view of the second gear 17, and FIG. 9B is a diagram illustrating the second gear 17 as viewed from the axial-direction first side Dx1.

Details of First Gear

First, the first gear 15 will be described with reference to FIGS. 8A and 8B. The first gear 15 of the present embodiment is different from the first gear 15 of the first embodiment illustrated in FIGS. 4A and 4B in that three claws 21*d* to 21*f* are additionally provided on the inner peripheral side of the three claws 21*a* to 21*c* of the first claw portion 21.

The first claw portion 21 of the present embodiment includes the three claws 21*a*, 21*b*, and 21*c* disposed on the outermost peripheral side and the three claws 21*d*, 21*e*, and 21*f* disposed on the inner peripheral side of the three claws 21*a*, 21*b*, and 21*c* and on the outer peripheral side of the second claw portion 22. The shapes of the additional claws 21*d* to 21*f* are substantially the same as those of the claws 21*a* to 21*c* except that the claws 21*d* to 21*f* are formed along an arc of a smaller radius than the claws 21*a* to 21*c* as viewed in the axial direction Dx. That is, the claws 21*d* to 21*f* each include the first transmission surface 211 and the inclined surface 212.

The claws 21*a* to 21*c* on the outer peripheral side are examples of claws of a first group arranged along an arc centered on the axis Ax among the plurality of claws of the first claw portion 21. The claws 21*d* to 21*f* on the inner peripheral side are examples of claws of a second group arranged along an arc centered on the axis Ax on the inner peripheral side of the claws of the first group in the rotational radius direction of the first gear 15 among the plurality of claws of the first claw portion 21.

Details of Second Gear

Next, the second gear 17 will be described with reference to FIGS. 9A and 9B. The second gear 17 of the present embodiment is different from the second gear 17 of the first embodiment illustrated in FIGS. 5A and 5B in that three claws 25*d* to 25*f* are additionally provided on the inner peripheral side of the three claws 25*a* to 25*c* of the third claw portion 25.

The third claw portion 25 of the present embodiment includes the three claws 25*a*, 25*b*, and 25*c* disposed on the outermost peripheral side and the three claws 25*d*, 25*e*, and 25*f* disposed on the inner peripheral side of the three claws 25*a*, 25*b*, and 25*c* and on the outer peripheral side of the fourth claw portion 26. The shapes of the additional claws 25*d* to 25*f* are substantially the same as those of the claws 25*a* to 25*c* except that the claws 25*d* to 25*f* are formed along an arc of a smaller radius than the claws 25*a* to 25*c* as viewed in the axial direction Dx. That is, the claws 25*d* to 25*f* each include the second transmission surface 251 and the inclined surface 252.

The claws 25*a* to 25*c* on the outer peripheral side are examples of claws of a third group arranged along an arc centered on the axis Ax among the plurality of claws of the third claw portion 25. The claws 25*d* to 25*f* on the inner peripheral side are examples of claws of a fourth group arranged along an arc centered on the axis Ax on the inner peripheral side of the claws of the third group in the rotational radius direction of the first gear 15 among the plurality of claws of the third claw portion 25.

Operation of Ratchet Mechanism Portion

Figure 10A:
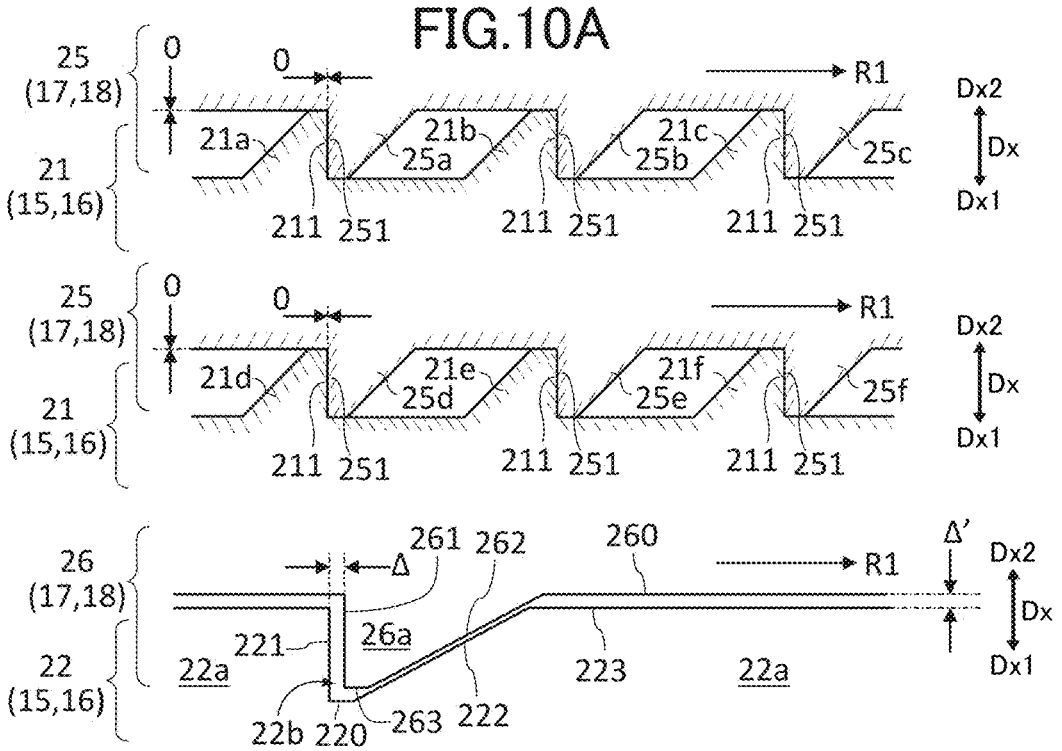
FIGS. 10A and 10B are each a diagram for describing a ratchet mechanism portion according to the second embodiment.
Figure 10B:
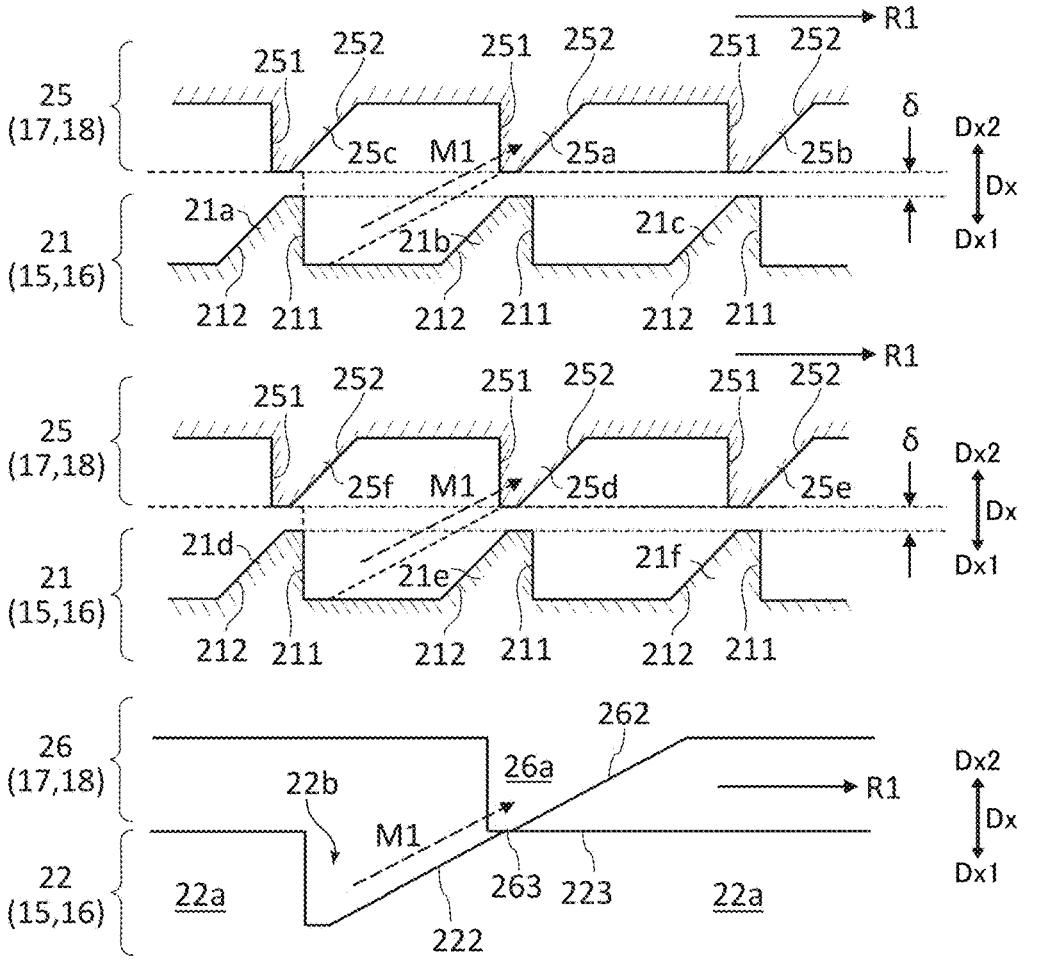

The operation of the ratchet mechanism portion 19R in the drive transmission state and the idling state will be described with reference to FIGS. 10A and 10B. FIG. 10A is a schematic diagram illustrating the positional relationship between the first ratchet portion 16 and the second ratchet portion 18 in the drive transmission state. FIG. 10B is a schematic diagram illustrating the positional relationship between the first ratchet portion 16 and the second ratchet portion 18 in the idling state. The respective upper portions of FIGS. 10A and 10B illustrate the cross-section of the virtual cylindrical surface of the ratchet mechanism portion 19R passing through the outer peripheral claws 21*a* to 21*c* and 25*a* to 25*c* of the first claw portion 21 and the third claw portion 25 projected onto a flat plane. The respective middle portions of FIGS. 10A and 10B illustrate the cross-section of the virtual cylindrical surface of the ratchet mechanism portion 19R passing through the inner peripheral claws 21*d* to 21*f* and 25*d* to 25*f* of the first claw portion 21 and the third claw portion 25 projected onto a flat plane. The respective lower portions of FIGS. 10A and 10B illustrate the cross-section of the virtual cylindrical surface of the ratchet mechanism portion 19R passing through the second claw portion 22 and the fourth claw portion 26 projected onto a flat plane.

In the ratchet mechanism portion 19R of the present embodiment, the additional claws 21*d* to 21*f* and 25*d* to 25*f* of the first claw portion 21 and the third claw portion 25 come into and out of contact at the same timing as the claws 21*a* to 21*c* and 25*a* to 25*c* of the first embodiment. Therefore, the operation of the ratchet mechanism portion 19R described below is basically the same as that of the first embodiment illustrated in FIGS. 7A and 7B.

That is, as illustrated in the upper portion and the middle portion of FIG. 10A, in the drive transmission state, the first gear 15 is positioned at the meshing position, and the first transmission surface 211 of each of the claws 21*a* to 21*f* of the first claw portion 21 comes into contact with the second transmission surface 251 of each of the claws 25*a* to 25*f* of the third claw portion 25. Therefore, the ratchet mechanism portion 19R can transmit the torque (driving force) in the first rotational direction R1 from the first gear 15 to the second gear 17 via the engagement between the first transmission surface 211 and the second transmission surface 251.

The first claw portion 21 and the third claw portion 25 each include six claws. Therefore, in the present embodiment, the number of engagement surfaces (contact portions or contact surfaces) where the plurality of first claws and the plurality of third claws come into contact with each other during the drive transmission period is 6.

As illustrated in the lower portion of FIG. 10A, the end surface 221 of the claw 22*a* of the second claw portion 22 and the end surface 261 of the claw 26*a* of the fourth claw portion 26 are disposed so as not to come into contact with each other in the drive transmission state. In the present embodiment, in the drive transmission state, a gap Δ is present between the end surface 221 and the end surface 261. This gap Δ is set to, for example, 4° in terms of the rotational angle about the axis Ax.

By providing the gap Δ and described above, in the drive transmission state, the driving force can be transmitted via the engagement between the first transmission surfaces 211 of the first claw portion 21 and the second transmission surfaces 251 of the third claw portion 25 without the second claw portion 22 and the fourth claw portion 26 contributing to the drive transmission.

In addition, as illustrated in the lower portion of FIG. 10A, in the drive transmission state, the claw 26*a* of the fourth claw portion 26 of the second ratchet portion 18 fits in the recess portion 22*b* of the second claw portion 22 of the first ratchet portion 16, and thus the first gear 15 is allowed to be positioned at the meshing position.

In the idling state, as illustrated in the lower portion of FIG. 10B, the first guide surface 222 of the second claw portion 22 of the first gear 15 slides on the second guide surface 262 of the fourth claw portion 26 of the second gear 17. As a result of this, the first gear 15 moves from the meshing position to the separated position in the axial direction Dx. Then, as illustrated in the upper portion and middle portion of FIG. 10B, the claws 21*a* to 21*f* of the first claw portion 21 and the claws 25*a* to 25*f* of the third claw portion 25 separate from each other in the axial direction Dx. That is, as a result of the first gear 15 retracting from the meshing position to the separated position due to the sliding between the first guide surface 222 and the second guide surface 262, the second gear 17 is allowed to rotate in the first rotational direction R1 with respect to the first gear 15 without interference between the first claw portion 21 and the third claw portion 25.

When the second gear 17 further rotates in the first rotational direction R1, the separation holding surface 223 of the second claw portion 22 and the distal end surface 263 of the fourth claw portion 26 starts being in contact with each other instead of the first guide surface 222 and the second guide surface 262 as illustrated in the lower portion of FIG. 10B. After this, while the separation holding surface 223 and the distal end surface 263 slide on each other, the second gear 17 rotates in the first rotational direction R1 in a state in which the first gear 15 is held at the separated position.

Then, in the case where the second gear 17 has rotated by 360° in the first rotational direction R1 with respect to the drive transmission state illustrated in FIG. 10A, the claw 26*a* of the fourth claw portion 26 opposes the recess portion 22*b* of the second claw portion 22 again. In this case, the first gear 15 starts moving from the separated position to the meshing position by the urging force of the urging spring 20. However, when the first guide surface 222 and the second guide surface 262 come into contact with each other, the first gear 15 is moved back to the separated position in accordance with the rotation of the second gear 17. As described above, in the present embodiment, the first guide surface 222 and the second guide surface 262 come into contact (collide) with each other each time the second gear 17 rotates once while the sheet is pulled out.

Also in the present embodiment, the first claw portion 21 is configured not to come into contact with the third claw portion 25 in the idling state of the ratchet mechanism portion 19R.

Specifically, the first guide surface 222 and the second guide surface 262 are formed such that the movement amount in the axial direction Dx of the retraction of the first gear 15 from the meshing position to the separated position is larger than the width in the axial direction Dx of the engagement surface where the first transmission surface 211 and the second transmission surface 251 come into contact with each other (engagement depth between the first claw portion 21 and the third claw portion 25). In the case where the difference between the above-described movement amount of the first gear 15 and the engagement depth between the first claw portion 21 and the third claw portion 25 is δ, for example, δ is set to 0.5 (mm). Therefore, a gap 8 is defined between the first claw portion 21 and the third claw portion 25 in the axial direction Dx in a state in which the first gear 15 is positioned at the separated position as illustrated in FIG. 10B.

In addition, the shape and placement of each claw of the first claw portion 21 and the third claw portion 25 are set such that the movement trajectory of the third claw portion 25 in the case where the first gear 15 and the second gear 17 relatively move due to the sliding between the first guide surface 222 and the second guide surface 262 does not interfere with the first claw portion 21.

According to the configuration described above, in the idling state, the second claw portion 22 and the fourth claw portion 26 come into contact with each other, and the first claw portion 21 and the third claw portion 25 do not come into contact with each other.

Merits of Present Embodiment

Also in the present embodiment, a function-separated configuration in which a shape (first claw portion 21 and third claw portion 25) having a function of transmitting the driving force of the drive source from the first gear 15 to the second gear 17 and a shape (second claw portion 22 and fourth claw portion 26) having a function of controlling the positional relationship in the axial direction Dx between the first gear 15 and the second gear 17 are provided separately is employed. As a result of this, for example, the following merits can be obtained.

(1) Durability of Claw Portions and Sound of Collision During Idling Period

In the present embodiment, the separation holding surface 223 substantially the same as the first embodiment is provided. Therefore, in the present embodiment, the number of times the first gear 15 moves from the separated position to the meshing position while the second gear 17 rotates once in the first rotational direction R1 with respect to the first gear 15 is suppressed to one. That is, in the present embodiment, the number of times of occurrence of a sound of collision caused by collision between the first guide surface 222 and the second guide surface 262 is only one per one rotation of the second gear 17 in the idling state.

In contrast, in the present embodiment, the driving force is transmitted via engagement between a plurality of claws provided separately from the separation holding surfaces 223 and 226 in the drive transmission state. In the present embodiment, the number of engagement surfaces at which the plurality of claws 21*a* to 21*f* (plurality of first claws) of the first claw portion 21 and the plurality of claws 25*a* to 25*f* (plurality of first claws) of the third claw portion 25 come into contact with each other during the drive transmission period is 6. In addition, the plurality of first transmission surfaces 211 and the plurality of second transmission surfaces 251 come into contact with each other at a plurality of contact positions in the first rotational direction R1. In the present embodiment, the number of contact positions included in the plurality of contact positions is 3.

As described above, the number of times the holding surface allows one of the first member and the second member to move from the separated position to the meshing position while the second member rotates once in a predetermined rotational direction with respect to the first member is smaller than the number of engagement surfaces at which the first transmission surfaces and the second transmission surfaces come into contact with each other during the drive transmission period. In addition, as described above, the number of times the holding surface allows the one of the first member and the second member to move from the separated position to the meshing position while the second member rotates once with respect to the first member is smaller than the number of contact positions included in the plurality of contact positions during the drive transmission period. As a result of this, the number of collisions between claws during the idling period can be reduced to reduce the sound of collision while improving the durability of the claw portion by increasing the number of claws.

(2) Durability of Claw Portion and Sheet Pull-Out Force

According to the present embodiment, in the rotational radius direction of the first gear 15, the first guide surface 222 and the second guide surface 262 are at more inward positions than the outermost position of the engagement surfaces between the first claw portion 21 and the third claw portion 25 during the drive transmission period. The outermost position of the engagement surfaces between the first claw portion 21 and the third claw portion 25 during the drive transmission period is the outermost position in the rotational radius direction of the engagement surfaces where the first transmission surfaces 211 and the second transmission surfaces 251 of the claws 21*d* to 21*f* and 25*d* to 25*f* on the outer peripheral side come into contact with each other. As a result of this, the force acting on the engagement surfaces between the claw portions during the drive transmission period can be reduced, and thus the durability of the first claw portion 21 and the third claw portion 25 can be improved. In addition, the resistance torque that the second gear 17 receives from the frictional force of the sliding between the first guide surface 222 and the second guide surface 262 can be reduced, and thus the sheet pull-out force for the jam removal process can be reduced.

In addition, according to the present embodiment, in the rotational radius direction of the first gear 15, the separation holding surface 223 is at a more inward position than the engagement surfaces between the first claw portion 21 and the third claw portion 25 during the drive transmission period. In the idling state, a frictional force is generated also between the separation holding surface 223 and the distal end surface 263 of the fourth claw portion 26. Therefore, by employing the arrangement described above, the sheet pull-out force for the jam removal process can be further reduced.

MODIFICATION EXAMPLE

Figure 11A:
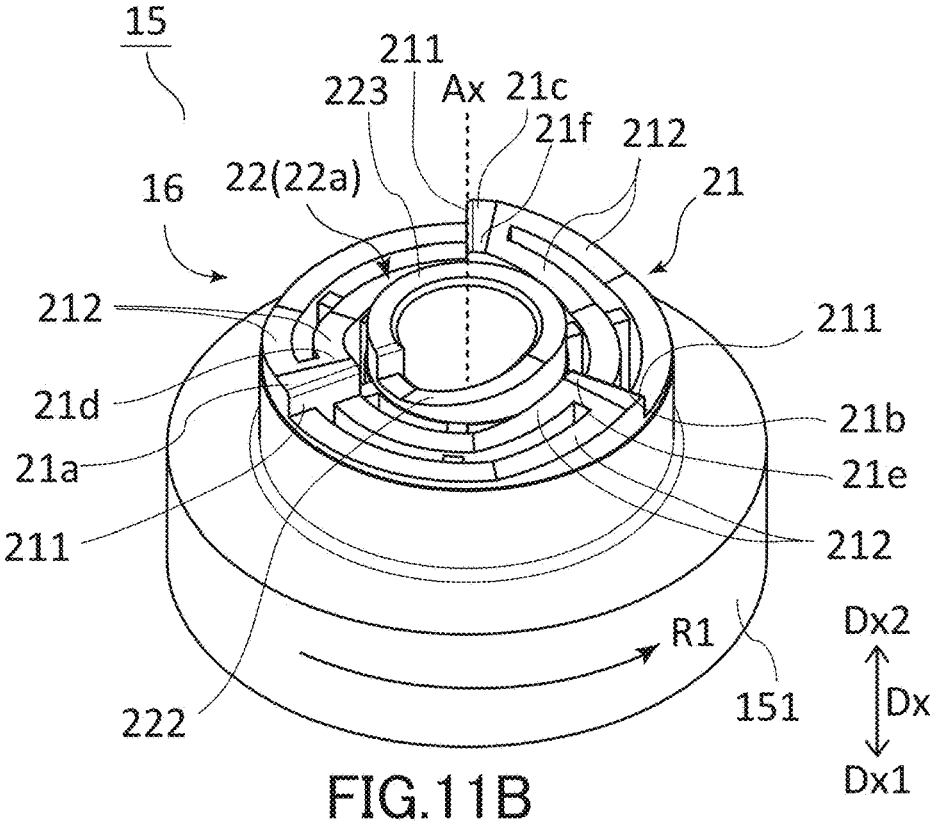
FIG. 11A is a perspective view of a first gear according to a modification example.
Figure 11B:
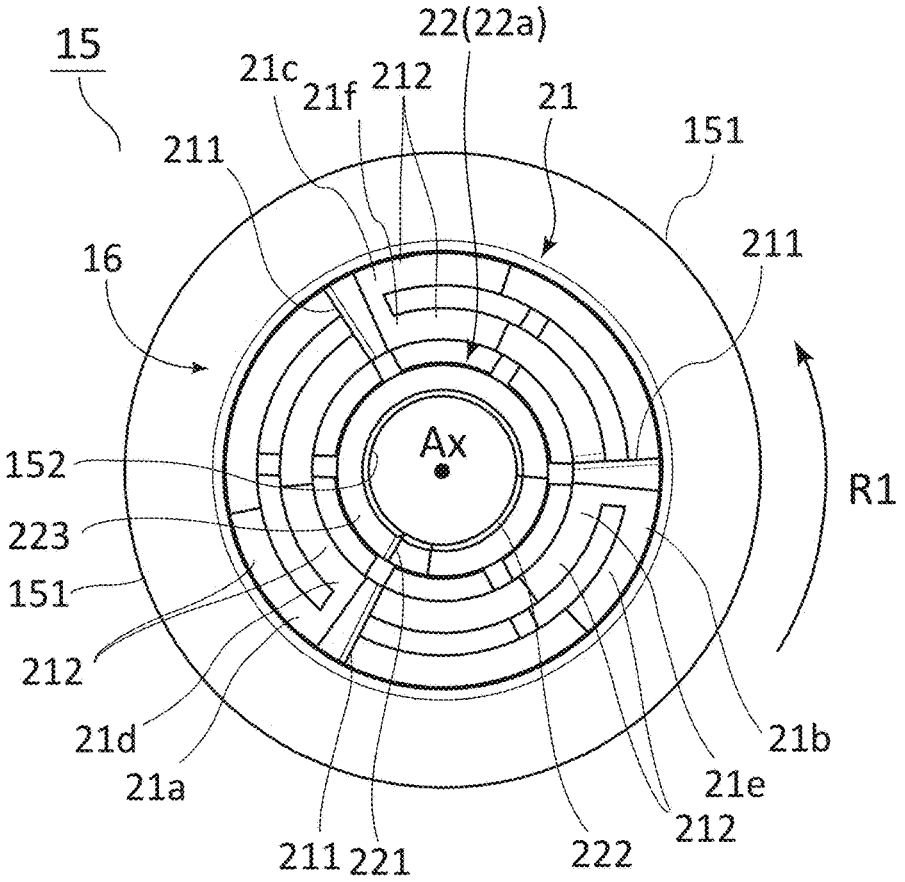
FIG. 11B is an axial direction view of the first gear according to the modification example.
Figure 12A:
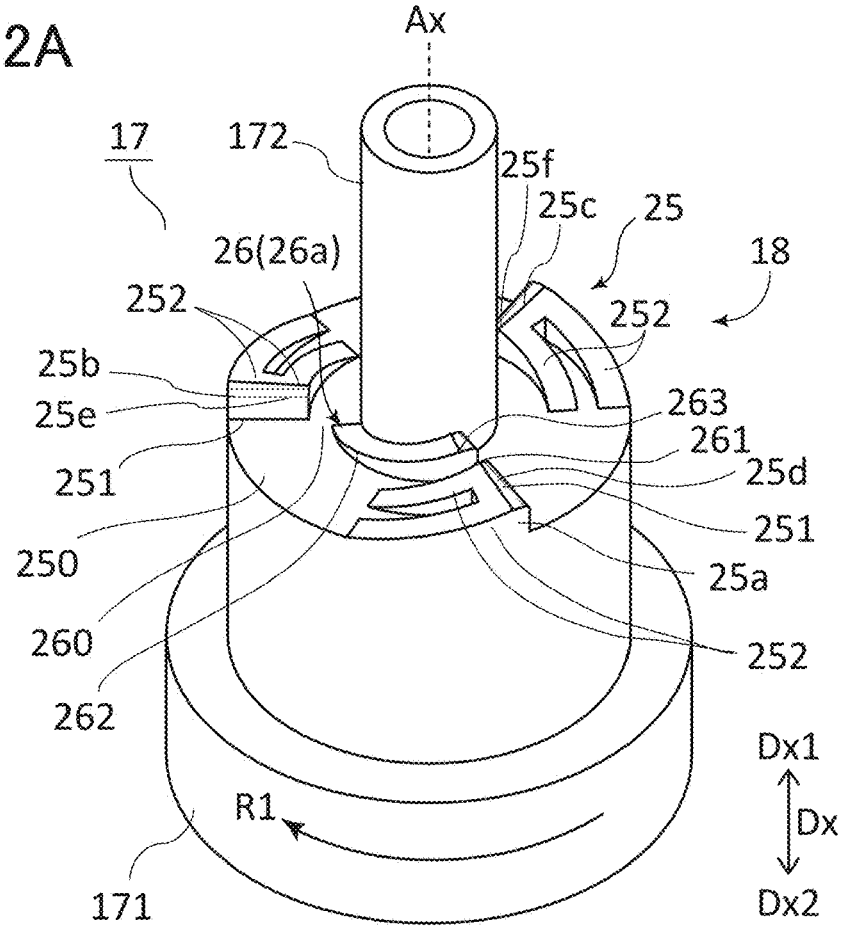
FIG. 12A is a perspective view of the first gear according to a modification example.
Figure 12B:
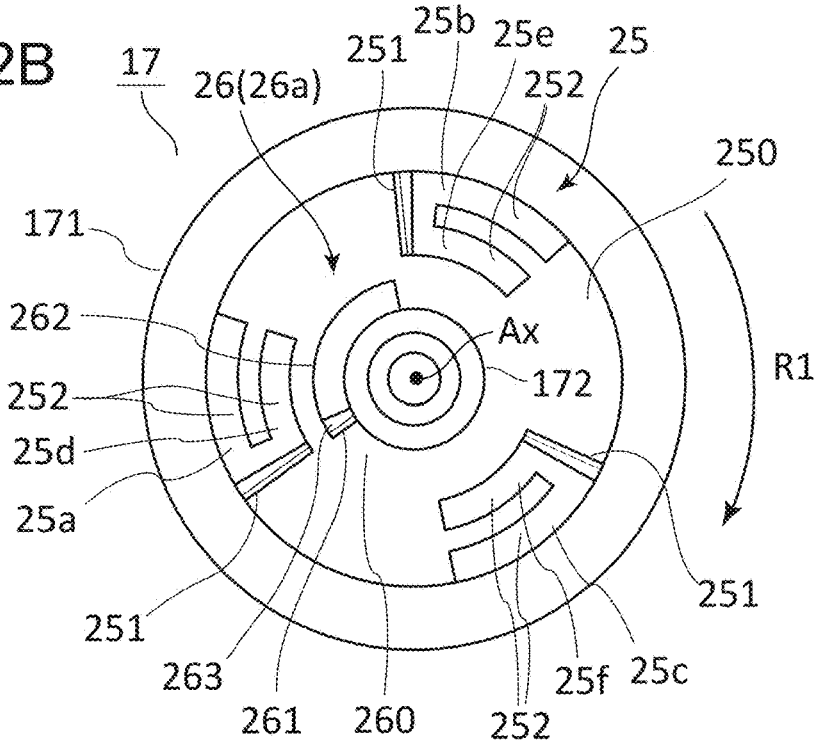
FIG. 12B is an axial direction view of the first gear according to the modification example.

As illustrated in FIG. 11, the outer peripheral claws 21*a* to 21*c* and the inner peripheral claws 21*d* to 21*f* of the first claw portion 21 described in the second embodiment may be connected to each other in the rotational radius direction of the first gear 15 to make the first transmission surface 211 wider. In addition, as illustrated in FIG. 12, the outer peripheral claws 25*a* to 25*c* and the inner peripheral claws 25*d* to 25*f* of the third claw portion 25 described in the second embodiment may be connected to each other in the rotational radius direction to make the second transmission surface 251 wider.

The width of the first transmission surface 211 in the rotational radius direction is larger than the width of the first guide surface 222 and the width of the second guide surface 262 in the rotational radius direction. In addition, the width of the second transmission surface 251 in the rotational radius direction is larger than the width of the first guide surface 222 and the width of the second guide surface 262 in the rotational radius direction.

By increasing the width of the first transmission surface 211 and the second transmission surface 251 in the rotational radius direction, the load on the first claw portion 21 and the third claw portion 25 can be dispersed, and thus the durability of the first claw portion 21 and the third claw portion 25 can be further improved.

To be noted, in the configuration in which a plurality of claws are disposed on the same circumference as in the first claw portion 21 and the third claw portion 25 described in the first and second embodiments, the width of the first transmission surface 211 or the second transmission surface 251 of each claw in the rotational radius direction may be increased.

In addition, although a configuration in which the plurality of first claws and the plurality of third claws are each divided into two groups and concentrically arranged in two rows has been described, the plurality of first claws and the plurality of third claws may be each divided into three or more groups and concentrically arranged in three or more rows. In addition, in the rotational direction about the axis Ax, the first claws of the first group and the first claws of the second group may be displaced from each other such that the first claws of the second group are positioned at rotational angles between the first claws of the first group.

Third Embodiment

A configuration according to a third embodiment will be described. In the description below, it is assumed that elements denoted by the same reference signs as in the first embodiment have substantially the same configurations and functions as those described in the first embodiment unless otherwise described, and parts different from the first embodiment will be mainly described.

In the present embodiment, the shapes of the first gear 15 and the second gear 17 are different from the first embodiment. The basic configuration of the ratchet mechanism portion 19R including the first gear 15 and the second gear 17 illustrated in FIG. 3, and the configuration of the sheet conveyance apparatus illustrated in FIG. 2 including the ratchet mechanism portion 19R and the configuration of the image forming apparatus illustrated in FIG. 1 can be set to those described in the first embodiment.

Figure 13A:
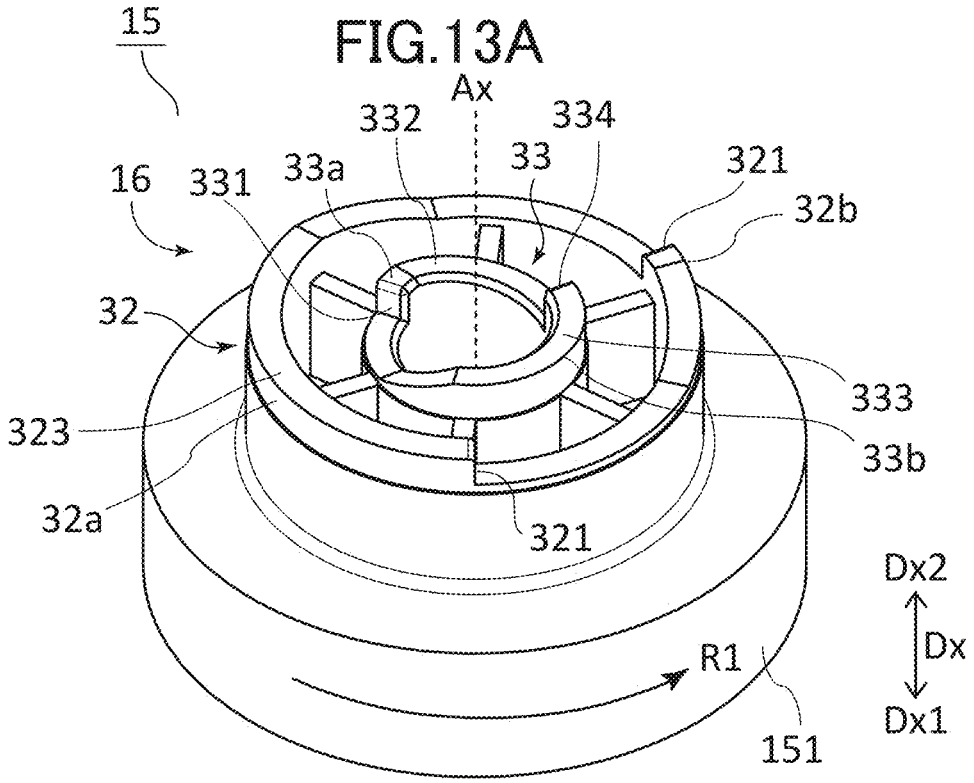
FIG. 13A is a perspective view of a first gear according to a third embodiment.
Figure 13B:
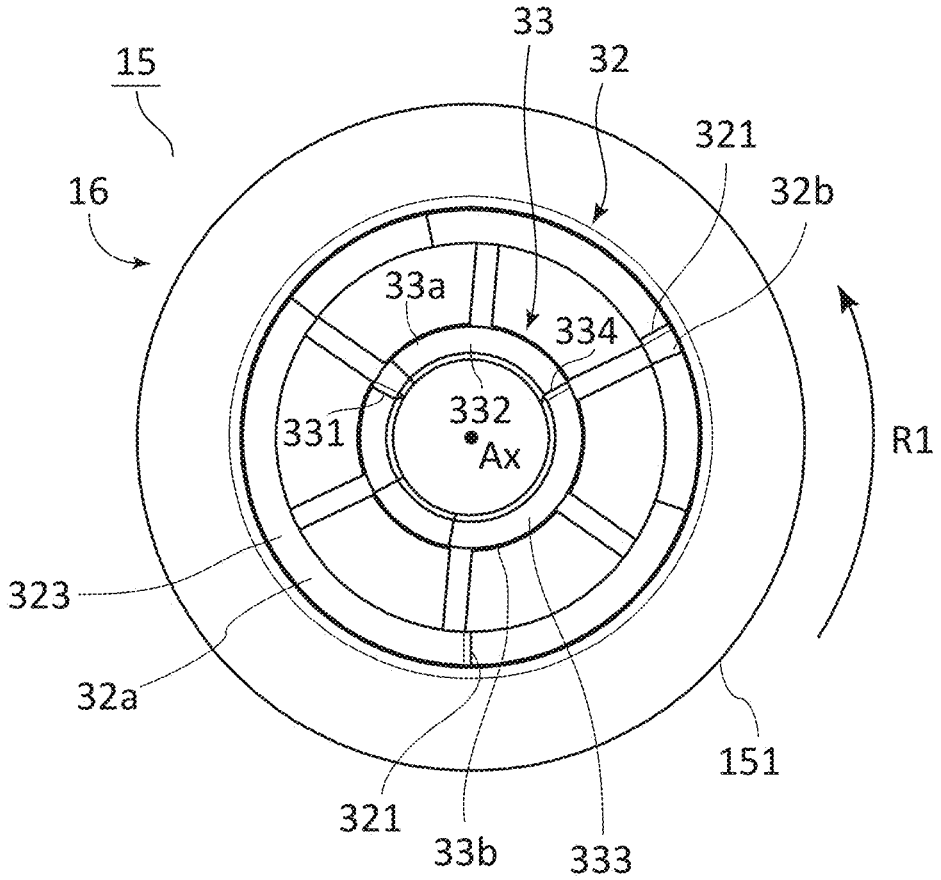
FIG. 13B is an axial direction view of the first gear according to the third embodiment.
Figure 14A:
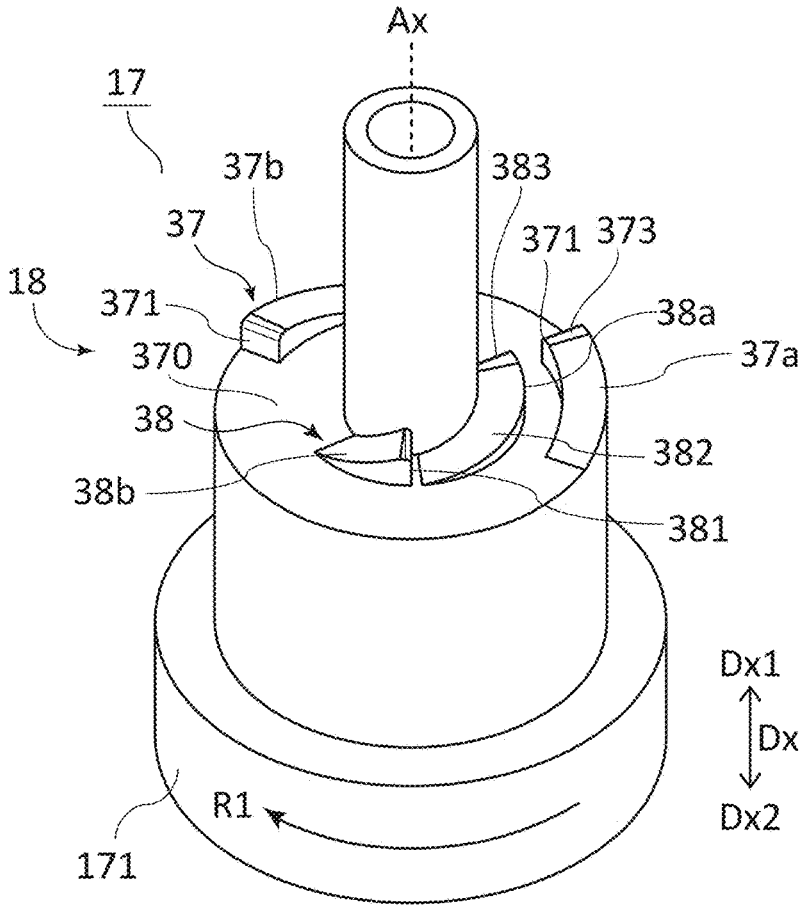
FIG. 14A is a perspective view of the first gear according to the third embodiment.
Figure 14B:
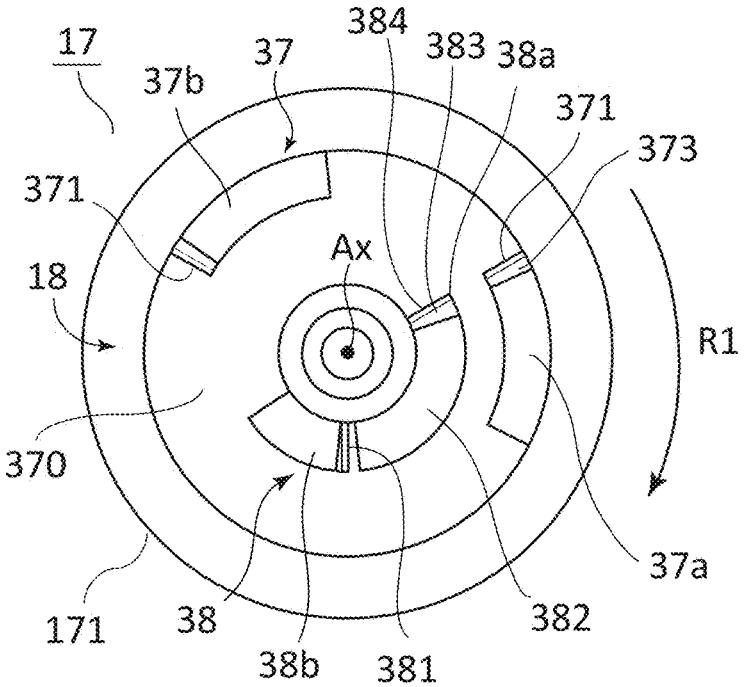
FIG. 14B is an axial direction view of the first gear according to the third embodiment.

In the description below, details of the first gear 15 and the second gear 17 will be further described with reference to FIGS. 13A, 13B, 14A, and 14B. FIG. 13A is a perspective view of the first gear 15, and FIG. 13B is a diagram illustrating the first gear 15 as viewed from the axial-direction second side Dx2. FIG. 14A is a perspective view of the second gear 17, and FIG. 14B is a diagram illustrating the second gear 17 as viewed from the axial-direction first side Dx1.

First, the first gear 15 will be described with reference to FIGS. 13A and 13B. The first gear 15 of the first ratchet portion 16 includes a first outer claw portion 32 and a first inner claw portion 33. In the rotational radius direction of the first gear 15, the first inner claw portion 33 is disposed at a more inward position than the first outer claw portion 32.

The first outer claw portion 32 and the first inner claw portion 33 each include at least one claw. The first outer claw portion 32 of the present embodiment includes two claws 32*a* and 32*b* (fifth claws, protrusions, or ratchet teeth). The first inner claw portion 33 of the present embodiment includes two claws 33*a* and 33*b* (sixth claws, protrusions, or ratchet teeth).

The claws 32*a* and 32*b* of the first outer claw portion 32 each have a transmission surface 321 for transmitting the driving force to the second gear 17. In addition, one (32*a*) of the claws 32*a* and 32*b* of the first outer claw portion 32 has a first separation holding surface 323. The first separation holding surface 323 is an example of a holding surface (first holding surface) that holds the first gear 15 at the separated position during the idling period of the ratchet mechanism portion 19R. The first separation holding surface 323 is a surface substantially orthogonal to the axial direction Dx, and extends along an arc centered on the axis Ax.

One (33*a*) of the claws 33*a* and 33*b* of the first inner claw portion 33 has a transmission surface 331 for transmitting the driving force to the second gear 17. One (33*a*) of the claws 33*a* and 33*b* of the first inner claw portion 33 has a third guide surface 332. The inclination (angle with respect to a plane orthogonal to the axial direction Dx) of the third guide surface 332 is smaller than the inclination of an inclined surface of the claw 33*b* not including the third guide surface 332. The inclined surface of the claw 33*b* is provided on the opposite side to the transmission surface 331.

In addition, one (33*b*) of the claws 33*a* and 33*b* of the first inner claw portion 33 has a second separation holding surface 333. The second separation holding surface 333 is an example of a holding surface (second holding surface) that holds the first gear 15 at the separated position during the idling period of the ratchet mechanism portion 19R. The second separation holding surface 333 is a surface substantially orthogonal to the axial direction Dx, and extends along an arc centered on the axis Ax.

The second gear 17 will be described with reference to FIGS. 14A and 14B. The second gear 17 of the second ratchet portion 18 includes a second outer claw portion 37 and a second inner claw portion 38. In the rotational radius direction of the second gear 17, the second inner claw portion 38 is disposed at a more inward position than the second outer claw portion 37.

The second outer claw portion 37 and the second inner claw portion 38 each include at least one claw. The second outer claw portion 37 of the present embodiment includes two claws 37*a* and 37*b* (seventh claws, protrusions, or ratchet teeth). The second inner claw portion 38 of the present embodiment includes two claws 38*a* and 38*b* (eighth claws, protrusions, or ratchet teeth).

The claws 37*a* and 37*b* of the second outer claw portion 37 each have a transmission surface 371 for receiving the driving force from the first gear 15. In addition, one (37*a*) of the claws 37*a* and 37*b* of the second outer claw portion 37 has a distal end surface 373 that slides on the first separation holding surface 323 described above. The projection height of the claw 37*a* that slides on the first separation holding surface 323 from a base surface 370 is larger than a projection height of the claw 37*b* that does not slide on the first separation holding surface 323 from the base surface 370.

One (38*a*) of the claws 38*a* and 38*b* of the second inner claw portion 38 has a transmission surface 381 for receiving the driving force from the first gear 15. One (38*a*) of the claws 38*a* and 38*b* of the second inner claw portion 38 has a fourth guide surface 382 that slides on the third guide surface 332 described above. The inclination (angle with respect to a plane orthogonal to the axial direction Dx) of the fourth guide surface 382 is smaller than the inclination of an inclined surface of the claw 38*b* not including the fourth guide surface 382. The inclined surface of the claw 38*b* is disposed on the opposite side to the transmission surface 381.

In addition, one (38*a*) of the claws 38*a* and 38*b* of the second inner claw portion 38 has a distal end surface 383 that slides on the second separation holding surface 333 described above. The projection height of the claw 38*a* that slides on the second separation holding surface 333 from the base surface 370 is larger than a projection height of the claw 38*b* that does not slide on the second separation holding surface 333 from the base surface 370.

The operation of the ratchet mechanism portion 19R in the present embodiment will be described with reference to FIGS. 15A to 15D. FIG. 15A is a schematic diagram illustrating the positional relationship between the first ratchet portion 16 and the second ratchet portion 18 in the drive transmission state. FIGS. 15B to 15D are each a schematic diagram illustrating the positional relationship between the first ratchet portion 16 and the second ratchet portion 18 in the idling state. The upper portion of each of FIGS. 15A to 15D illustrates the cross-section of the virtual cylindrical surface of the ratchet mechanism portion 19R passing through the first outer claw portion 32 of the first ratchet portion 16 and the second outer claw portion 37 of the second ratchet portion 18 projected onto a flat plane. The lower part of each of FIGS. 15A to 15D illustrates the cross-section of the virtual cylindrical surface of the ratchet mechanism portion 19R passing through the first inner claw portion 33 of the first ratchet portion 16 and the second inner claw portion 38 of the second ratchet portion 18 projected onto a flat plane.

Drive Transmission State

As illustrated in the upper portion of FIG. 15A, the first gear 15 is positioned at the meshing position (engaged position) in the drive transmission state. In this state, the transmission surface 321 of each of the claws 32*a* and 32*b* of the first outer claw portion 32 and the transmission surface 371 of each of the claws 37*a* and 376 of the second outer claw portion 37 come into contact (engage) with each other. In addition, the transmission surface 331 of the claw 33*a* of the first inner claw portion 33 and the transmission surface 381 of the claw 38*b* of the second inner claw portion 38 come into contact with each other. Therefore, the ratchet mechanism portion 19R can transmit the torque (driving force) in the first rotational direction R1 from the first gear 15 and the second gear 17 via the engagement of the transmission surfaces 321 and 331 with the transmission surfaces 371 and 381.

The first ratchet portion 16 has three transmission surfaces 321 and 331 in total, and the second ratchet portion 18 has three transmission surfaces 371 and 381 in total. Therefore, in the present embodiment, the number of engagement surfaces (contact portions or contact surfaces) where the claws of the first ratchet portion 16 and the claws of the second ratchet portion 18 come into contact with each other during the drive transmission period is 3.

As illustrated in the lower portion of FIG. 15A, an end surface 384 of the claw 38*a* of the second inner claw portion 38 having the fourth guide surface 382 is disposed so as not to come into contact with an end surface 334 of the claw 33*b* of the first inner claw portion 33 opposing the end surface 384 in the drive transmission state. In the present embodiment, in the drive transmission state, a gap Δ is present between the end surface 334 and the end surface 384.

Idling State

When the sheet is pulled out from the conveyance roller 14 in a state in which the motor 19 is stopped, the second gear 17 rotates in the first rotational direction R1 with respect to the first gear 15. In this case, as illustrated in FIG. 15B, the third guide surface 332 of the first inner claw portion 33 and the fourth guide surface 382 of the second inner claw portion 38 slide on each other, and thus the first gear 15 moves from the meshing position to the separated position. While the third guide surface 332 and the fourth guide surface 382 slide on each other, the claws 32*a*, 32*b*, and 33*b* of the first ratchet portion 16 other than the claw 33*a* having the third guide surface 332 and the claws 37*a*, 37*b*, and 38*b* of the second ratchet portion 18 other than the claw 38*a* having the fourth guide surface 382 do not come into contact with each other.

In the present embodiment, the first gear 15 moves (retracts) from the meshing position to the separated position while the second gear 17 rotates in the first rotational direction R1 by a predetermined first angle (for example, about 120°) with respect to the drive transmission state illustrated in FIG. 15A.

In the case where the second gear 17 rotates by more than the first angle with respect to the drive transmission state, the first separation holding surface 323 of the first outer claw portion 32 and the distal end surface 373 of the claw 37*a* of the second outer claw portion 37 start sliding on each other instead of the third guide surface 332 and the fourth guide surface 382 as illustrated in the upper portion of FIG. 15C. After this, while the first separation holding surface 323 and the distal end surface 373 slide on each other, the second gear 17 rotates in the first rotational direction R1 in a state in which the first gear 15 is held at the separated position by the first separation holding surface 323. Meanwhile, at this step, the second separation holding surface 333 of the first inner claw portion 33 is not yet in contact with the distal end surface 383 of the claw 38*a* of the second inner claw portion 38 as illustrated in the lower portion of FIG. 15C.

In the case where the second gear 17 rotates by a second angle larger than the first angle with respect to the drive transmission state, the second separation holding surface 333 of the first inner claw portion 33 and the distal end surface 383 of the claw 38*a* of the second inner claw portion 38 start sliding on each other as illustrated in the lower portion of FIG. 15D instead of the first separation holding surface 323 and the distal end surface 373. After this, while the second separation holding surface 333 and the distal end surface 383 slide on each other, the second gear 17 rotates in the first rotational direction R1 in a state in which the first gear 15 is held at the separated position by the first separation holding surface 323. Meanwhile, after the sliding between the second separation holding surface 333 and the distal end surface 383 is started, the first separation holding surface 323 separates from the distal end surface 373 as illustrated in an upper portion of FIG. 15D.

Then, in the case where the second gear 17 has rotated by 360° in the first rotational direction R1 with respect to the drive transmission state illustrated in FIG. 15A, the sliding between the second separation holding surface 333 and the distal end surface 383 is finished. In this case, the first gear 15 is moved from the separated position to the meshing position by the urging force of the urging spring 20. However, when the third guide surface 332 and the fourth guide surface 382 come into contact with each other, the first gear 15 is moved back to the separated position in accordance with the rotation of the second gear 17. As described above, in the present embodiment, the third guide surface 332 and the fourth guide surface 382 come into contact (collide) with each other each time the second gear 17 rotates once while the sheet is pulled out.

Incidentally, in the idling state of the ratchet mechanism portion 19R, claws that do not slide on any of the third guide surface 332, the fourth guide surface 382, the first separation holding surface 323, and the second separation holding surface 333 preferably do not come into contact with any other claw. That is, claws that do not contribute to retraction of the first gear 15 from the meshing position to the separated position or to holding of first gear 15 at the separated position preferably do not come into contact with other claws during the idling period of the second gear 17. In the present embodiment, the one claw 37*b* of the second outer claw portion 37 and the one claw 38*b* of the second inner claw portion 38 do not come into contact with any claw of the first outer claw portion 32 and the first inner claw portion 33 in the idling state.

Specifically, the third guide surface 332 and the fourth guide surface 382 are formed such that the movement amount in the axial direction Dx of the retraction of the first gear 15 from the meshing position to the separated position is larger than the width in the axial direction Dx of the engagement surface between the transmission surface 371 of the claw 37*b* and the transmission surface 321 of the claw 32*a* in the drive transmission state and the width in the axial direction Dx of the engagement surface between the transmission surface 381 of the claw 38*b* and the transmission surface 331 of the claw 33*a* in the axial direction Dx. The projection height of the claw 37*b* and the projection height of the claw 38*b* with respect to the base surface 370 are smaller than the projection height of the claw 37*a* that slides on the first separation holding surface 323. In addition, the projection height of the claw 37*b* and the projection height of the claw 38*b* with respect to the base surface 370 are smaller than the projection height of the claw 38*a* that slides on the second separation holding surface 333.

As illustrated in FIGS. 15B to 15D, in a state in which the first gear 15 is positioned at the separated position, a gap 8 in the axial direction Dx is present between the claw 37*b* of the second outer claw portion 37 and each of the claws 35*a* and 35*b* of the first outer claw portion 35. In addition, in the state in which the first gear 15 is positioned at the separated position, the gap 8 in the axial direction Dx is present between the claw 38*b* of the second inner claw portion 38 and each of the claws 36*a* and 36*b* of the first inner claw portion 36.

In addition, as illustrated in FIG. 15B, the movement trajectory of the claws 37*b* and 38*b* in the case where the first gear 15 and the second gear 17 relatively move due to the sliding between the third guide surface 332 and the fourth guide surface 382 does not interfere with each claw of the first gear 15.

Merits of Present Embodiment

As described above, in the present embodiment, the first separation holding surface 323 and the second separation holding surface 333 for holding the first gear 15 at the separated position in the idling state are disposed on a plurality of claw portions arranged at different positions in the rotational radius direction of the first gear 15. As a result of this, after the first gear 15 has retracted from the meshing position to the separated position during the idling period, the first separation holding surface 323 and the second separation holding surface 333 take turns to hold the first gear 15 at the separated position. In other words, after one of the first member and the second member has retracted from the meshing position to the separated position during the idling period, a state in which one of the first member and the second member is held at the separated position by the first holding surface as illustrated in FIG. 15C and a state in which one of the first member and the second member is held at the separated position by the second holding surface as illustrated in FIG. 15D are switched.

According to the present embodiment, since a plurality of holding surfaces are distributed to a plurality of claw portions, the range of each holding surface in the rotational direction about the axis Ax can be made narrower than the configuration in which only one holding surface is used. As a result of this, the transmission surfaces 331 and 321 for transmitting the driving force from the first gear 15 to the second gear 17 can be disposed in a range where the holding surfaces are not provided. That is, as compared with a configuration in which the first gear 15 is held at the separated position by only one holding surface during the idling period, more transmission surfaces are provided, thus the load on the claw portions during the drive transmission period can be dispersed, and the durability of the claw portions can be improved.

In addition, since the plurality of holding surfaces are distributed to a plurality of claw portions, the plurality of claw portions take turns to slide on the holding surfaces during the idling period. Therefore, the load on the claw portion sliding on the holding surface during the idling period can be distributed to the plurality of holding surfaces and the plurality of claw portions, and thus the durability of the claw portions can be improved.

According to the present embodiment, since a plurality of holding surfaces take turns to hold the first gear 15 at the separated position during the idling period, the number of times the first gear 15 returns from the separated position to the meshing position while the second gear 17 rotates once can be suppressed to 1. Meanwhile, the number of engagement surfaces of the first outer claw portion 32 and the first inner claw portion 33 with the second outer claw portion 37 and the second inner claw portion 38 during the drive transmission period is 3. In addition, the plurality of first transmission surfaces (321 and 331) and the plurality of second transmission surfaces (371 and 382) come into contact with each other at a plurality of contact positions in the first rotational direction R1. In the present embodiment, the number of the plurality of contact positions is 3. That is, the number of times the first holding surface and the second holding surface allow one of the first member and the second member to move from the separated position to the meshing position while the second member rotates once in a predetermined rotational direction with respect to the first member is smaller than the number of engagement surfaces at which the first outer claw portion and the first inner claw portion engage with the second outer claw portion and the second inner claw portion during the drive transmission period. In addition, the number of times the first holding surface and the second holding surface allow the one of the first member and the second member to move from the separated position to the meshing position while the second member rotates once in a predetermined rotational direction with respect to the first member is smaller than the number of contact positions included in the plurality of contact positions during the drive transmission period. As a result of this, the number of collisions between claws during the idling period can be reduced to reduce the sound of collision while improving the durability of the claw portion by increasing the number of claws. The energy (amount of work) for the user to pull out the sheet from the conveyance roller 14 can be reduced, and thus the jam removal process can be made easier.

In addition, at least part of the engagement surface between the first outer claw portion 32 and the first inner claw portion 33 and the second outer claw portion 37 and the second inner claw portion 38 during the drive transmission period is at a more outward position than the sliding surface between the third guide surface 332 and the fourth guide surface 382 during the idling period in the rotational radius direction of the first gear 15. As a result of this, the force acting on the engagement surface between the claw portions during the drive transmission period can be reduced, and thus the durability of the claw portions can be improved. In addition, the resistance torque that the second gear 17 receives from the frictional force of the sliding between the third guide surface 332 and the fourth guide surface 382 can be reduced, and thus the sheet pull-out force for the jam removal process can be reduced.

To be noted, although a configuration in which the first gear 15 and the second gear 17 each include claw portions of two rows along concentric arcs has been described in the present embodiment, claw portions of three or more rows arranged concentrically may be provided.

OTHER EMBODIMENTS

Although an apparatus that conveys a sheet toward a transfer portion in an image forming apparatus has been described as an example of a sheet conveyance apparatus that conveys a sheet in the embodiments described above, the sheet conveyance apparatus may convey the sheet for a different purpose. For example, the feeding roller of the feeding portion 2 illustrated in FIG. 1 and the driving mechanism that drives the feeding roller are another example of the sheet conveyance apparatus. In addition, the present technique may be applied to not only a sheet conveyance apparatus that conveys a sheet serving as a recording material in an image forming apparatus body but also a sheet conveyance apparatus that conveys a sheet in an attached apparatus that is used in connection to the image forming apparatus body. Examples of the attached apparatus include a large-capacity sheet feeding apparatus (optional feeder) that feeds a sheet to the image forming apparatus body, a sheet processing apparatus (finisher) that performs processing on a sheet having undergone image formation, and an image reading apparatus for reading image information from a document.

According to the present disclosure, a sheet conveyance apparatus and an image forming apparatus including a new driving mechanism can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-199833, filed on Dec. 14, 2022, which is hereby incorporated by reference herein in its entirety.

What is claimed is:

1. A sheet conveyance apparatus comprising:

a conveyance member configured to convey a sheet;

a drive source configured to generate a driving force;

a first member including a first ratchet portion and being configured to be rotationally driven in a predetermined rotational direction about an axis by the driving force, wherein the first ratchet portion has a plurality of first transmission surfaces and a first guide surface;

a second member opposing the first member in an axial direction of the axis, the second member including a second ratchet portion and being configured to rotate about the axis to transmit the driving force received from the first member to the conveyance member, wherein the second ratchet portion has a plurality of second transmission surfaces and a second guide surface; and an urging portion configured to urge one of the first member and the second member toward another of the first member and the second member in the axial direction, wherein the one of the first member and the second member is movable in the axial direction between an engaged position where the plurality of first transmission surfaces is engaged with the plurality of second transmission surfaces, and a separated position where the plurality of first transmission surfaces is separated from the plurality of second transmission surfaces in the axial direction, wherein during a drive transmission period in which the first member is rotationally driven in the rotational direction by the driving force of the drive source, the second member and the first member rotate together in the rotational direction in a state in which (i) the one of the first member and the second member is positioned in the engaged position, (ii) the plurality of first transmission surfaces is in contact with the plurality of second transmission surfaces at a plurality of contact positions in the rotational direction, wherein during an idling period in which the conveyance member is rotated in a state in which the drive source is stopped, the first guide surface and the second guide surface slide on each other such that the one of the first member and the second member is retracted from the engaged position to the separated position against an urging force of the urging portion, and thus the second member is allowed to rotate in the rotational direction with respect to the first member, wherein at least one of the first ratchet portion and the second ratchet portion has a holding surface configured to slide on another of the first ratchet portion and the second ratchet portion after the one of the first member and the second member has retracted from the engaged position to the separated position during the idling period, and thus hold the one of the first member and the second member at the separated position, and wherein the number of times the holding surface allows the one of the first member and the second member to move from the separated position to the engaged position while the second member rotates once in the rotational direction with respect to the first member is smaller than the number of contact positions included in the plurality of contact positions during the drive transmission period.

2. The sheet conveyance apparatus according to claim 1, wherein in a rotational radius direction of the first member, at least part of contact portions which are formed between the plurality of first transmission surfaces and the plurality of second transmission surfaces is at a more outward position than a sliding surface between the first guide surface and the second guide surface during the idling period.

3. The sheet conveyance apparatus according to claim 2, wherein in the rotational radius direction, at least part of the contact portions is at a more outward position than a sliding surface between the holding surface and the other of the first ratchet portion and the second ratchet portion during the idling period.

4. The sheet conveyance apparatus according to claim 1, wherein a movement amount in the axial direction of retraction of the one of the first member and the second member from the engaged position to the separated position caused by sliding between the first guide surface and the second guide surface is larger than a width of each of contact portions which are formed between the plurality of first transmission surfaces and the plurality of second transmission surfaces in the axial direction during the drive transmission period.

5. The sheet conveyance apparatus according to claim 1, wherein the number of times the holding surface allows the one of the first member and the second member to move from the separated position to the engaged position while the second member rotates once in the rotational direction with respect to the first member is 1.

6. The sheet conveyance apparatus according to claim 1, wherein the holding surface is formed in a range of 180° or more in terms of a rotational angle about the axis.

7. The sheet conveyance apparatus according to claim 1, wherein the first guide surface and the second guide surface are each a surface having a spiral shape with the axis as a central axis, and wherein the holding surface is a surface intersecting with the axial direction.

8. The sheet conveyance apparatus according to claim 1, wherein the first ratchet portion includes a first claw portion and a second claw portion, the first claw portion including a plurality of claws each having one of the plurality of first transmission surfaces, the second claw portion including a claw having the first guide surface, and wherein the second ratchet portion includes a third claw portion and a fourth claw portion, the third claw portion including a plurality of claws each having one of the plurality of second transmission surfaces, the fourth claw portion including a claw having the second guide surface.

9. The sheet conveyance apparatus according to claim 8, wherein the first claw portion and the third claw portion are configured not to come into contact with each other in a period in which the first guide surface and the second guide surface slide on each other during the idling period.

10. The sheet conveyance apparatus according to claim 8, wherein in a state in which the holding surface is in contact with the other of the second claw portion and the fourth claw portion, a gap is present between the first claw portion and the third claw portion in the axial direction.

11. The sheet conveyance apparatus according to claim 8, wherein during the drive transmission period, a gap is present between a downstream end surface of the claw of the second claw portion in the rotational direction and an upstream end surface of the claw of the fourth claw portion in the rotational direction.

12. The sheet conveyance apparatus according to claim 8, wherein the claws of the first claw portion each have a first inclined surface provided on the opposite side to the first transmission surface thereof in the rotational direction, wherein the claws of the third claw portion each have a second inclined surface provided on the opposite side to the second transmission surface thereof in the rotational direction, and wherein inclination of the first guide surface and the second guide surface with respect to a plane orthogonal to the axial direction is smaller than inclination of the first inclined surface and the second inclined surface with respect to the plane orthogonal to the axial direction.

13. The sheet conveyance apparatus according to claim 8, wherein the plurality of claws of the first claw portion are arranged along an arc centered on the axis, and wherein the plurality of claws of the third claw portion are arranged along an arc centered on the axis.

14. The sheet conveyance apparatus according to claim 8, wherein the plurality of claws of the first claw portion include claws of a first group arranged along an arc centered on the axis, and claws of a second group arranged along an arc centered on the axis at more inward positions than the claws of the first group in a rotational radius direction of the first member, and wherein the plurality of claws of the third claw portion include claws of a third group arranged along an arc centered on the axis, and claws of a fourth group arranged along an arc centered on the axis at more inward positions than the claws of the third group in the rotational radius direction.

15. The sheet conveyance apparatus according to claim 1, wherein width of the first transmission surface in a rotational radius direction of the first member is larger than width of the first guide surface in the rotational radius direction, and wherein width of the second transmission surface in the rotational radius direction is larger than width of the second guide surface in the rotational radius direction.

16. A sheet conveyance apparatus comprising:

a conveyance member configured to convey a sheet;

a drive source configured to generate a driving force;

a first member including a first ratchet portion and being configured to be rotationally driven in a predetermined rotational direction about an axis by the driving force, wherein the first ratchet portion has a first transmission surface and a first guide surface;

a second member opposing the first member in an axial direction of the axis, the second member including a second ratchet portion and being configured to rotate about the axis to transmit the driving force received from the first member to the conveyance member, wherein the second ratchet portion has a second transmission surface and a second guide surface; and an urging portion configured to urge one of the first member and the second member toward another of the first member and the second member in the axial direction, wherein the one of the first member and the second member is movable in the axial direction between an engaged position where the first transmission surface is engaged with the second transmission surface, and a separated position where the first transmission surface is separated from the second transmission surface in the axial direction, wherein during a drive transmission period in which the first member is rotationally driven in the rotational direction by the driving force of the drive source, the second member rotates in the rotational direction together with the first member in a state in which (i) the one of the first member and the second member is positioned in the engaged position, and (ii) a contact portion between the first transmission surface and the second transmission surface is formed, wherein during an idling period in which the conveyance member is rotated in a state in which the drive source is stopped, the first guide surface and the second guide surface slide on each other such that the one of the first member and the second member is retracted from the engaged position to the separated position against an urging force of the urging portion, and thus the second member is allowed to rotate in the rotational direction with respect to the first member, and wherein in a rotational radius direction of the first member, at least part of the contact portion during the drive transmission period is at a more outward position than a sliding surface between the first guide surface and the second guide surface during the idling period.

17. The sheet conveyance apparatus according to claim 16, wherein in the rotational radius direction, entirety of the first transmission surface is at a more outward position than the first guide surface and the second guide surface, and entirety of the second transmission surface is at a more outward position than the first guide surface and the second guide surface.

18. The sheet conveyance apparatus according to claim 16, wherein at least one of the first ratchet portion and the second ratchet portion has a holding surface configured to slide on another of the first ratchet portion and the second ratchet portion after the one of the first member and the second member has retracted from the engaged position to the separated position during the idling period, and thus hold the one of the first member and the second member at the separated position, and wherein in the rotational radius direction, at least part of the contact portion during the drive transmission period is at a more outward position than a sliding surface between the holding surface and the other of the first ratchet portion and the second ratchet portion during the idling period.

19. The sheet conveyance apparatus according to claim 18, wherein in the rotational radius direction, entirety of the first transmission surface is at a more outward position than the holding surface, and entirety of the second transmission surface is at a more outward position than the holding surface.

20. A sheet conveyance apparatus comprising:

a conveyance member configured to convey a sheet;

a drive source configured to generate a driving force;

a first member including a first ratchet portion and configured to be rotationally driven in a predetermined rotational direction about an axis by the driving force, wherein the first ratchet portion includes a first outer claw portion and a first inner claw portion disposed at a more inward position than the first outer claw portion in a rotational radius direction of the first member;

a second member opposing the first member in an axial direction of the axis, the second member including a second ratchet portion and being configured to rotate about the axis to transmit the driving force received from the first member to the conveyance member, wherein the second ratchet portion includes a second outer claw portion and a second inner claw portion disposed at a more inward position than the second outer claw portion in the rotational radius direction of the first member; and an urging portion configured to urge one of the first member and the second member toward another of the first member and the second member in the axial direction, wherein the one of the first member and the second member is movable in the axial direction between an engaged position where the first outer claw portion and the first inner claw portion are respectively engaged with the second outer claw portion and the second inner claw portion, and a separated position where the first outer claw portion and the first inner claw portion are respectively separated from the second outer claw portion and the second inner claw portion in the axial direction, wherein during a drive transmission period in which the first member is rotationally driven in the rotational direction by the driving force of the drive source, the second member and the first member rotate together in the rotational direction in a state in which the one of the first member and the second member is positioned at the engaged position, wherein during an idling period in which the conveyance member is rotated in a state in which the drive source is stopped, a third guide surface provided on the first outer claw portion and the first inner claw portion and a fourth guide surface provided on the second outer claw portion and the second inner claw portion slide on each other such that the one of the first member and the second member is retracted from the engaged position to the separated position against an urging force of the urging portion, and thus the second member is allowed to rotate in the rotational direction with respect to the first member, wherein at least one of the first outer claw portion and the second outer claw portion has a first holding surface, wherein at least one of the first inner claw portion and the second inner claw portion has a second holding surface, and wherein after the one of the first member and the second member has retracted from the engaged position to the separated position during the idling period, the sheet conveyance apparatus switches to a state in which the one of the first member and the second member is held at the separated position by the first holding surface and a state in which the one of the first member and the second member is held at the separated position by the second holding surface.

21. The sheet conveyance apparatus according to claim 20, wherein during the drive transmission period, the first outer claw portion and the first inner claw portion come into contact with the second outer claw portion and the second inner claw portion at a plurality of contact positions in the rotational direction, and wherein the number of times the first holding surface and the second holding surface allow the one of the first member and the second member to move from the separated position to the engaged position while the second member rotates once in the rotational direction with respect to the first member is smaller than the number of contact positions included in the plurality of contact positions during the drive transmission period.

22. The sheet conveyance apparatus according to claim 20, wherein in a rotational radius direction of the first member, at least part of a contact portion where the first outer claw portion and the first inner claw portion come into contact with the second outer claw portion and the second inner claw portion during the drive transmission period is at a more outward position than a sliding surface between the third guide surface and the fourth guide surface during the idling period.

23. An image forming apparatus comprising:

the sheet conveyance apparatus according to claim 1; and an image forming portion configured to form an image on a sheet conveyed by the sheet conveyance apparatus.

* * * * *